US007066379B2

(12) United States Patent
McLeod et al.

(10) Patent No.: US 7,066,379 B2
(45) Date of Patent: Jun. 27, 2006

(54) SHIPPING CONTAINER CONVERTIBLE TO A DISPLAY CONTAINER

(75) Inventors: Michael B. McLeod, Romeoville, IL (US); Oscar Rochefort, Naperville, IL (US)

(73) Assignee: Smurfit-Stone Container Enterprises, Inc., Chicago, IL (US)

( * ) Notice: Subject to any disclaimer, the term of this patent is extended or adjusted under 35 U.S.C. 154(b) by 362 days.

(21) Appl. No.: 10/236,618

(22) Filed: Sep. 6, 2002

(65) Prior Publication Data

US 2003/0116613 A1 Jun. 26, 2003

Related U.S. Application Data

(60) Provisional application No. 60/317,618, filed on Sep. 6, 2001.

(51) Int. Cl.
*B65D 25/04* (2006.01)
*B65D 5/32* (2006.01)

(52) U.S. Cl. ..... 229/120.26; 229/120.24; 229/121; 229/122.21; 229/122.24; 229/242; 229/120.29; 229/120.37; 229/122.3

(58) Field of Classification Search ..... 206/774; 229/120.03, 120.24, 120.26, 120.33, 143, 229/240, 121, 122.21, 122.24, 120.29, 122.3
See application file for complete search history.

(56) References Cited

U.S. PATENT DOCUMENTS

| | | | |
|---|---|---|---|
| 448,813 | A | 3/1891 | Bowman |
| 1,262,992 | A | 4/1918 | Stephano |
| 1,430,149 | A | 9/1922 | Bliss |
| 1,794,821 | A | 3/1931 | Andrews |
| 2,012,942 | A | 9/1935 | Acker |
| 2,193,925 | A | 3/1940 | Huye |
| 2,581,105 | A | 1/1952 | Hunsworth |
| 2,671,597 | A | 3/1954 | Leavitt |
| 2,671,600 | A | 3/1954 | Leavitt |
| 2,766,923 | A | 10/1956 | D'Esposito |
| 2,822,970 | A | 2/1958 | Froggatt et al. |
| 2,904,239 | A | 9/1959 | Wilcox |
| 2,920,757 | A | 1/1960 | Garman |
| 2,925,210 | A | 2/1960 | Fallert |
| 2,989,226 | A | 6/1961 | Swartz |
| 3,167,179 | A | 1/1965 | Goldstein |
| 3,260,440 | A | 7/1966 | Foley |
| 3,348,667 | A | 10/1967 | Beeby |
| 3,425,544 | A | 2/1969 | Ayer et al. |
| 3,428,234 | A | 2/1969 | Du Barry, Jr. |
| RE26,557 | E | 3/1969 | Houston |
| 3,433,401 | A | 3/1969 | Swift |
| 3,650,459 | A | 3/1972 | Tucker |
| 3,653,495 | A | 4/1972 | Gray |

(Continued)

FOREIGN PATENT DOCUMENTS

| | | |
|---|---|---|
| GB | 2 221 670 | 2/1990 |

(Continued)

*Primary Examiner*—Tri M. Mai
(74) *Attorney, Agent, or Firm*—Armstrong Teasdale LLP

(57) ABSTRACT

Shipping containers that are convertible to display containers are disclosed. The containers comprise wrap around outer shells of the general type known as "Bliss" wraps, in combination with interior vertical support structures. The invention presents improved two- and three-piece container constructions, having improved side-to-end panel connections for improved tray strength upon conversion to a display configuration, as well as a variety of interior divider/support options. By advantageous adhesive application together with specialized opening structures such as tear strips, lines of weakness and/or hand holes, various different conversion configurations are provided.

8 Claims, 26 Drawing Sheets

U.S. PATENT DOCUMENTS

| | | | |
|---|---|---|---|
| 3,810,573 | A | 5/1974 | Russell et al. |
| 3,850,363 | A | 11/1974 | Jacobs |
| 3,921,893 | A | 11/1975 | Randle, Jr. |
| 3,985,286 | A | 10/1976 | Hicks |
| 4,030,600 | A | 6/1977 | Heaps |
| 4,184,625 | A | 1/1980 | Stollberg et al. |
| 4,191,288 | A | 3/1980 | Hostad |
| 4,282,999 | A | 8/1981 | Moen |
| 4,328,924 | A | 5/1982 | Neff et al. |
| 4,427,108 | A | 1/1984 | Coles et al. |
| 4,512,511 | A | 4/1985 | Zimmermann |
| 4,519,538 | A | 5/1985 | Omichi |
| 4,635,795 | A | 1/1987 | DeFlander et al. |
| 4,697,699 | A | 10/1987 | Schneider |
| 4,705,162 | A | 11/1987 | Kupersmit |
| 4,779,737 | A | 10/1988 | Umehara et al. |
| 4,784,271 | A | 11/1988 | Wosaba, II et al. |
| 4,793,494 | A | 12/1988 | Gordon, Jr. |
| 4,848,651 | A | 7/1989 | Hartness |
| 4,871,067 | A | 10/1989 | Valenti |
| 5,105,950 | A | 4/1992 | Gottfreid et al. |
| 5,143,278 | A | 9/1992 | Petriekis et al. |
| 5,293,991 | A | 3/1994 | Neumann et al. |
| 5,419,485 | A | 5/1995 | Petriekis et al. |
| 5,443,205 | A | 8/1995 | Robotham et al. |
| 5,464,149 | A | 11/1995 | Fowler et al. |
| 5,505,369 | A | 4/1996 | Taliaferro |
| 5,507,430 | A | 4/1996 | Imhoff |
| 5,520,325 | A | 5/1996 | Quaintance |
| 5,555,982 | A | 9/1996 | Kuhn et al. |
| 5,657,872 | A | 8/1997 | Leftwich et al. |
| 5,758,818 | A | 6/1998 | Ewing, Jr. |
| 5,950,911 | A | 9/1999 | Naughton et al. |
| 5,967,406 | A | 10/1999 | Moorman |
| 6,168,027 | B1 | 1/2001 | Esser |
| 6,352,199 | B1 * | 3/2002 | Gardner ..... 229/122.26 |

FOREIGN PATENT DOCUMENTS

| | | | |
|---|---|---|---|
| GB | 2 313 828 | A | 12/1997 |

* cited by examiner

INTERIOR OPTIONS

ANOTHER INTERIOR OPTION

<<<==FLUTE DIRECTION==>>>

SHIPPING CONTAINER CONVERTIBLE TO A DISPLAY CONTAINER

The present application claims priority of provisional application Ser. No. 60/317,618, filed Sep. 6, 2001.

BACKGROUND OF THE INVENTION

1. Field of the Invention

The present invention relates to shipping containers, in particular shipping containers that are fabricated at least in part from paper, paperboard and/or corrugated paperboard material. The present invention also relates to such containers that are readily openable without implements and/or are convertible from a shipping configuration, to a display configuration.

2. The Prior Art

In stores that deal in dry goods sold in their own individual containers, such as grocery stores, a traditional method for placing the goods on display would be for store personnel to open the shipping containers in which the goods have been shipped from the supplier, and individually place each item on the shelf, and arrange them neatly for presentation. Typically, such containers were often structures dedicated solely to a shipping function, and when opened, were either destroyed, or resulted in an open-topped container not well suited for merchandising functions.

However, this process of individual removal of goods from a shipping container, and placement on shelves, is relatively costly to the store in terms of personnel effort, time, wages, etc. Therefore, it has become desirable to reduce costs in converting goods packaged for shipping into a suitable format for display and shopping.

This has resulted in the development of a variety of containers which are configured to be convertible from a shipping configuration, to a display configuration, which permits the converted container to be placed directly upon a shelf, or floor display, without having to remove the individual product items from the container. Typically, this is accomplished by providing the container with removable portions of the container that create apertures through which customers may then help themselves to the products within the converted container.

Such convertible containers represent a challenge in that they must be readily convertible into a form presentable to customers, while at the same time maintaining certain shipping performance characteristics, suitable for the shipment of non-self-supporting or even fragile products. In order to reduce cost in opening and placement of the converted container, the container should be hand-convertible, without the use of a knife or other implement. At the same time, it is desirable to provide a converted display container that is relatively free of unsightly or inconvenient rough edges or debris.

However, such prior art convertible containers often are either lacking in the necessary shipping performance characteristics or, in order to provide such performance, even after conversion, have structural elements that remain in position and make access to the product less convenient than desired. Other container constructions may achieve one or both of the performance or convenience goals, but at the expense of an inefficient or simply excessive use of container material.

Retailers require packaging that provides maximum performance at a reasonable economic cost, but that is also capable of being easily converted into a merchandisable display package with a minimum of effort. Two-piece container designs of the type referred to, as "Bliss" containers are generally known, due to their economic balance of different materials. However, while some manufacturers have offered design options which include features that allow the containers to be modified into acceptable tray designs for merchandising, such prior art solutions have often been at the expense of the performance of the package, e.g., requiring perforations in the vertical support structures, which may compromise significant stacking strength and may negatively impact package integrity during distribution. Even after display conversion, many of the known prior art designs leave a large portion of the outer container intact, obscuring much of the product inside the shipper, compromising the overall intent of the display conversion features.

It is accordingly desirable to provide a shipping container that is convertible to a display configuration, that has improved shipping performance characteristics, together with enhanced ease of conversion, and improved "shopability" for the consumer.

These and other desirable characteristics of the present invention will become apparent in view of the present specification and drawings.

SUMMARY OF THE INVENTION

The present invention is directed, in part, to a shipping container convertible to a display container, having a top, a bottom, first and second sides, and first and second ends. The shipping container comprises an outer cover member formed from a first blank, including a bottom panel for forming the bottom of the shipping container. First and second side panels emanate from first and second opposing sides of the bottom panel. First and second end panels emanate from first and second opposing ends of the bottom panel, the first and second end panels further including a lower portion, an upper portion, at least one of the first and second end panels further including a zone of weakness enabling separation of the lower portion from the upper portion of the at least one of the first and second end panels. Minor flaps emanate from one of the ends of the first and second side panels or the ends of the first and second end panels, and are affixed to one of the outer surfaces of the first and second end panels or the outer surfaces of the first and second side panels, respectively. At least one top panel emanates from a top edge of at least one of the first and second end panels.

An internal support member is formed from at least a second blank, for providing support to the at least one top panel. The upper portions of the first and second end panels are affixed to portions of the internal support member.

In a preferred embodiment of the invention, both of the first and second end panels include a zone of weakness enabling separation of the lower portion from the upper portion of each of the first and second end panels, and wherein the internal support member is affixed to only at least one of the upper portions of the first and second end panels and the at least one top panel, so that upon separation of the upper portions of the first and second end panels from the lower portions of the first and second end panels, the internal support member may be separated from the lower portions of the first and second end panels, the first and second side panels and the bottom panel, to result in a tray for displaying products that may be contained therein.

In a preferred embodiment of the invention, the at least one top panel includes a first portion connected to the upper portion of the at least one end panel having a zone of weakness between the upper and lower portions thereof, the first portion of the at least one top panel being releasably connected to the internal support member, whereupon separation of the upper portion of the at least one end panel having a zone of weakness between the upper and lower portions thereof from the lower portion, the first portion of the at least one top panel being separable from the internal support member, to expose at least a portion of the interior of the shipping container.

In a preferred embodiment of the invention, the at least one top panel comprises two discrete top panels emanating from the top edges of the upper portions of the first and second end panels. The two discrete top panels have juxtaposed free edges that meet so that a top area of the container is substantially covered by the two discrete top panels. Alternatively, the two discrete top panels have juxtaposed free edges that are spaced apart such that a portion of a top area of the container is left exposed and not covered by the two discrete top panels.

Preferably, the at least one top panel further comprises at least one top flap, emanating from a side edge of the at least one top panel, and affixed to the internal support member.

The zone of weakness is preferably one of the following: a score line; a tear strip; at least one transverse line of perforations; a punchout formed from a line of perforations defining an enclosed area, the enclosed area within the line of perforations being affixed to the internal support member.

The shipping container may further include at least one punchout formed in at least one side panel, formed from a closed line of perforations defining an enclosed area, the enclosed area within the line of perforations being affixed to the internal support member.

The shipping container may further comprise a tape seal connecting the juxtaposed free edges of the two discrete top panels.

The internal support member preferably has one of the following top plan configurations upon articulation: rectangular; C-shaped; C-shaped with flanges at right angles to the ends of the legs of the C; E-shaped; E-shaped with flanges at right angles to the ends of the legs of the E; H-shaped; H-shaped with flanges at right angles to the ends of the legs of the H; H-shaped with L-shaped flanges at right angles to the ends of the legs of the H.

The present invention also comprises a "three-piece" shipping container convertible to a display container, having a top, a bottom, first and second sides, and first and second ends, comprising a tray member formed from a first blank, including a bottom panel for forming the bottom of the shipping container. First and second side panels emanate from first and second opposing sides of the bottom panel. First and second end panels emanate from first and second opposing ends of the bottom panel. Minor flaps emanate from one of the end of the first and second side panels or the ends of the first and second end panels, and are affixed to one of the outer surfaces of the first and second end panels or the outer surfaces of the first and second side panels, respectively. A cover member is formed from a second blank, including a top panel. First and second side panels emanate from first and second opposing sides of the top panel. An internal support member is formed from at least a third blank, for providing support to the top panel; the cover member being affixed to the internal support member. At least one zone of weakness is disposed between first and second portions of the tray member for enabling separation of the first portions of the tray member from the second portions of the tray member, the first portions of the tray member being affixed to the internal support member, whereupon separation of the first portions and second portions of the tray member, the cover member, the internal support member and the first portions of the tray member may be separated from the second portions of the tray member to result in a tray for displaying products contained within the shipping container.

Preferably the at least one zone of weakness comprises at least one tear strip disposed between the first and second portions of the tray member, and the first portions of the tray member comprise a flap emanating from the tear strip and affixed to the internal support member. The at least one zone of weakness may further preferably comprise two tear strips disposed between first and second portions of the tray member, and the first portions of the tray member comprise a flap emanating from each tear strip and affixed to the internal support member.

In an alternative embodiment of the invention, the at least one zone of weakness comprises at least one punchout formed from a line of perforations defining an enclosed area, the enclosed area within the line of perforations being affixed to the internal support member, whereby the first portions of the tray member comprise the at least one punchout and the second portions of the tray member comprises regions surrounding and immediately adjacent to the at least one punchout.

In the "three-piece" embodiment of the invention, the cover member preferably comprises, in addition to the top panel, first and second top side panels, emanating from side edges of the top panel, and at least one of at least one top end flap emanating from an end edge of the top panel and at least one top side flap emanating from a side edge of the top panel. At least one of the top panel, the first and second top side panels, the at least one top end flap and the at least one top side flap are affixed to the internal support member.

Preferably, the first and second top side panels have bottom edges that are one of the following: straight, arcuately concave, angularly notched. Preferably, the internal support member has one of the following top plan configurations upon articulation: rectangular; C-shaped; C-shaped with flanges at right angles to the ends of the legs of the C; E-shaped; E-shaped with flanges at right angles to the ends of the legs of the E; H-shaped; H-shaped with flanges at right angles to the ends of the legs of the H; H-shaped with L-shaped flanges at right angles to the ends of the legs of the H.

The internal support member preferably includes a transversely extending wall having an opening therein, for enabling visual inspection of a rear portion of the interior of the container, through the internal support member.

DETAILED DESCRIPTION OF THE DRAWINGS

Figure 1:
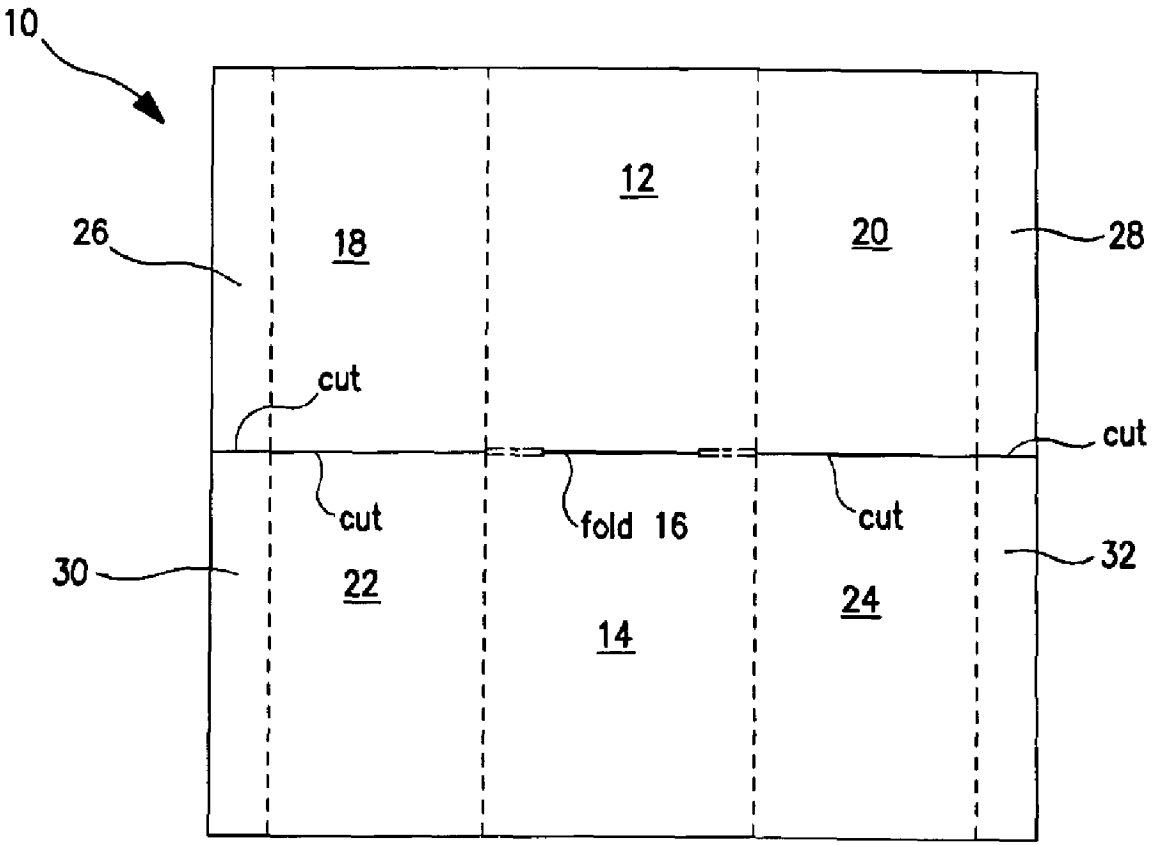
FIG. 1 is a plan view of a blank for forming an interior support structure for a convertible shipping and display container, according to a preferred embodiment of the invention.

While this invention is susceptible of embodiment in many different forms, there are shown in the drawings and will be described in detail, several specific embodiments, with the understanding that the present disclosure is to be considered as an exemplification of the principles of the invention and is not intended to limit the invention to the embodiments illustrated.

The present invention is directed to an improved "Bliss"-style shipping container, fabricated from paper, paperboard and/or corrugated paperboard, that is convertible to a display tray. The container, generally, comprises a strong vertical structure (interior) providing general structural support, and an outer wrap, typically fabricated from a lighter weight paper, paperboard or corrugated paperboard material, providing containment and closure. In the containers of the present invention, the interior structure is advantageously connected (typically glued) strategically and minimally to the interior surfaces of the outer wrap and can be separated simply through hand articulation and the use of special design features such as perforated holes or tear strips.

A particular distinguishing feature, among others, which is believed to enhance the performance of the containers of the present invention relates to the positioning and configuration of the minor flanges off of the horizontal base panel of the outer wrap. In the present invention, these minor flanges are positioned so that when such a container is formed, using known automatic forming equipment, known to those of ordinary skill in the art, the minor flanges fold up, wrap around, and are adhered to the outside surfaces of the vertical ends or sides of the package (depending upon the wrap direction). Erecting the flaps in this manner permits the horizontal base of the wrap to form the basis of a tray.

Adhesive is applied in a strategic manner, adhering only the upper portions of the interior to the upper wrap regions and by having the flanges extended off of the horizontal base area adhered to the outer ends or sides of the package. Just above the outer end or sidewall areas of adhesion, perforated design features, such as a tear strip and/or holes may be located. When these features are hand articulated, they sever the connection of the upper portions of the wrap, from the lower portions of the wrap, permitting the upper portion of the wrap, together with the attached interior structural members, to be drawn off, leaving a shallow tray for 360 degree display merchandising.

By including additional perforations in the wrap, the design can also be display converted to reveal only one side of the product. This option may be advantageously employed in a club store environment, for example, when the product is contemplated to be shopped directly out of the shipping container on the pallet, or off the shelf in a cooler.

Incorporating both of these features into a package give a merchandiser the option of how to convert the package for display merchandising. The merchandiser may either tear off the front and top of the upper portion of one side of the wrap for pallet or stacked merchandising, or the merchandiser can use the perforations/tear strip at the sides or ends to fully remove the interior for full tray display.

One advantage of the present invention is that the special features provide for containment and closure during distribution, but do not negatively affect the interior vertical support structure, which could compromise the stacking performance of the critical components of the container, and of the container itself. In addition, conversion to a display configuration is accomplished with relative ease and minimal effort.

When referring to the plan illustrations of the blanks, the usual drawing conventions are applied. That is, unless otherwise noted, broken lines indicate fold lines; scalloped lines indicate lines of weakness forming a tear strip or similar structure; and interior solid lines indicate through-cuts.

FIG. 1 is a plan view of a blank for forming an interior support structure for a convertible shipping and display container, according to a preferred embodiment of the invention. Blank (interior support structure) 10 includes center panels 12, 14, which are joined along fold line 16, side panels 18, 20, 22, 24, and flanges 26, 28, 30, 32. In a preferred embodiment of the invention, the blank is formed from a suitably selected corrugated paperboard material, in which the corrugations run in a direction parallel to the short axis of blank 10, i.e., perpendicular to fold line 16.

Figure 2:
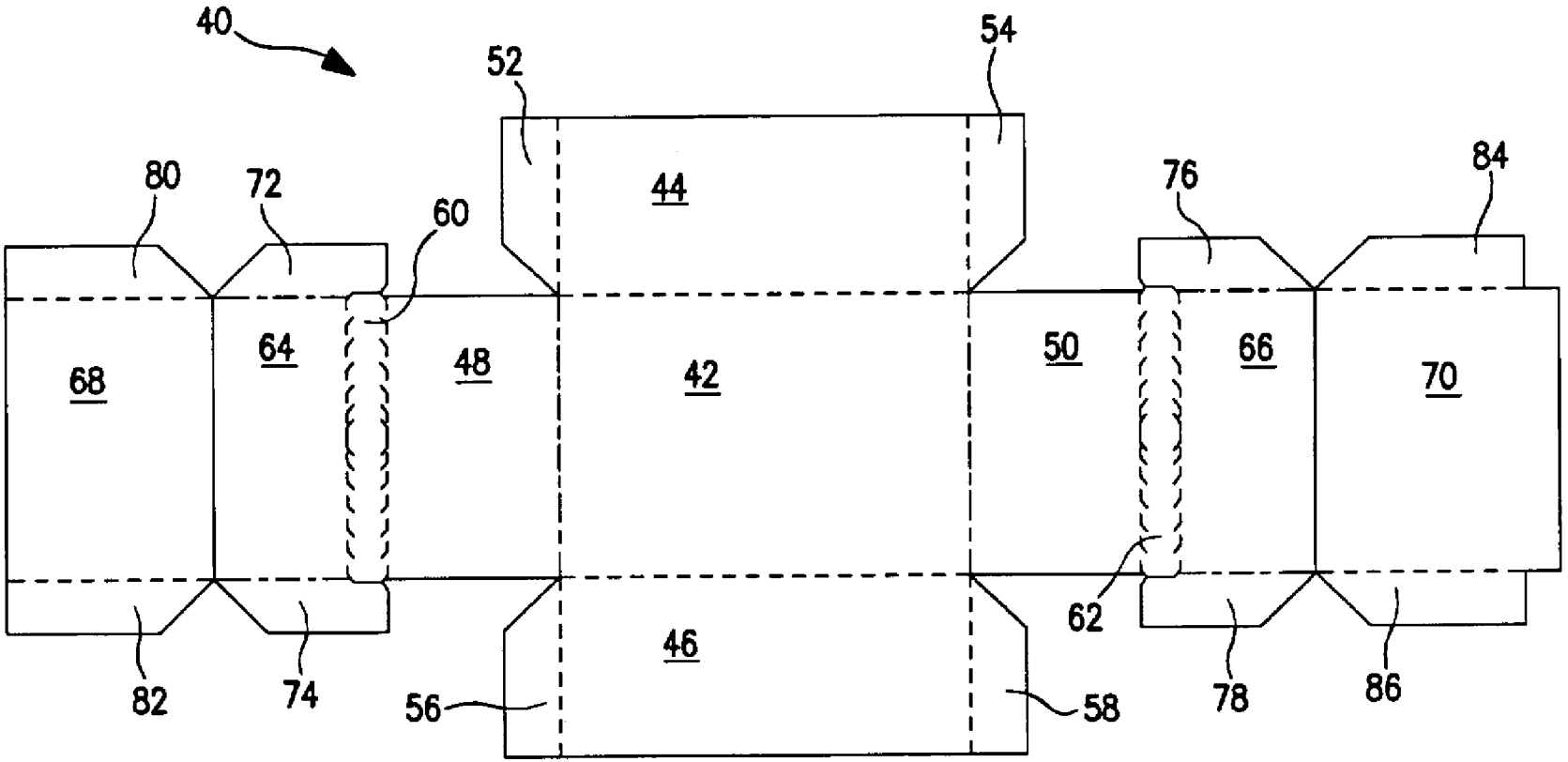
FIG. 2 is a plan view of a blank for forming an exterior tray Bliss style wrap for a convertible shipping and display container, according to a preferred embodiment of the invention.

FIG. 2 is a plan view of a blank for forming an exterior "Bliss"-style wrap for a convertible shipping and display container, according to a preferred embodiment of the invention. Blank (outer wrap) 40 includes bottom panel 42; sidewalls 44, 46; lower end panels 48, 50; lower end flanges 52, 54, 56 and 58; tear strips 60, 62; upper end panels 64, 66; top panels 68, 70; upper end flanges 72, 74, 76 and 78; and top flanges 80, 82, 84 and 86. In a preferred embodiment of the invention, the blank is formed from a suitably selected corrugated paperboard material, in which the corrugations run in a direction parallel to the long axis of blank 40.

The container that may be obtained from blanks 10 and 40 may be erected by known container erecting equipment, with modifications readily obtained by one of ordinary skill in the art, having the present disclosure before them. Blank (interior support structure) 10 is erected in accordance with FIGS. 3 and 16. Blank (outer wrap) 40 is erected in accordance with FIG. 3.

FIG. 3 is a development illustration showing how a container, formed from the components illustrated in FIGS. 1 and 2, may be opened and broken down, to remove the upper portions of the outer wrap and the entirety of the interior support structure, to leave a display tray, for merchandising of the goods contained in the container. FIG. 3*c* shows an erected, loaded and sealed container 100; FIG. 3*a* shows the finished mechanically erected container ready for product loading through the top; FIG. 3*b* shows the detailed erected form of the two package components as they related to one another within the erected, combined package; FIG. 3*d* shows the package after it is converted for 360° display merchandising by removing the tear strips and drawing off the joined upper top and interior portions; and FIG. 3*e* shows the alternative method of converting the container for stacked pallet or end of aisle merchandising through the removal of a tear strip and a portion of the wrap.

As will be apparent to one of ordinary skill in the art, having the present disclosure before them, adhesive will be strategically applied to the inside surfaces of various ones of the panels of the outer wrap 40, to obtain the pattern of release of the various panels, shown in the various stages of development of FIG. 3. Flanges 80, 82, 84 and 86 are firmly adhered to the outside surface panels 18, 20, 22 and 24, and, in preferred embodiments of the invention, are not intended to be released during package articulation and conversion into a display configuration. Likewise, flanges 72, 74, 76 and 78 are firmly adhered to the inside vertical support structure 10. In order to provide for a robust lower portion of the outer wrap, as much adhesive as desired, may be applied, e.g., to the inside surfaces of flanges 52, 54, 56 and 58. Additional adhesive may be applied at various locations, as desired, by one of ordinary skill in the art, having the present disclosure before them, as required by the needs of any given application.

Figure 3C:
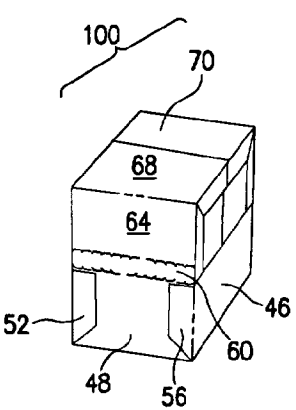
FIG. 3*c* is a perspective view of a fully erected container according to the embodiment of FIGS. 3*a* and 3*b*.
Figure 3B:
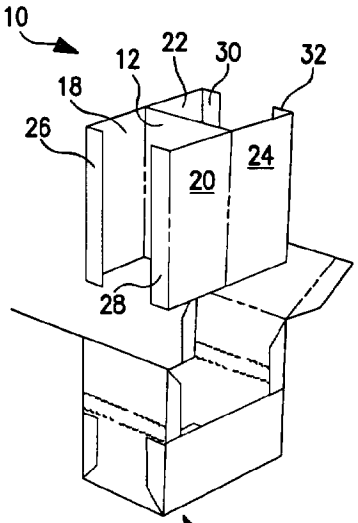
FIG. 3*b* is a perspective view of the container of FIG. 3*a*, prior to insertion of the internal support/divider.
Figure 3E:
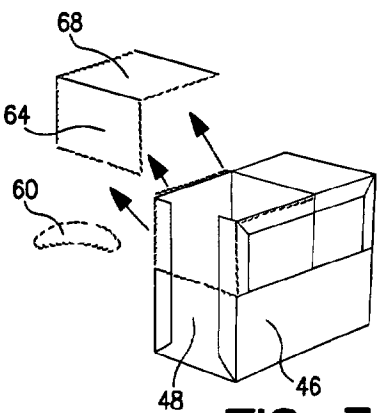
FIG. 3*e* is a perspective view of a container according to FIGS. 3*a*–3*c* being converted for stacked pallet or end-of-aisle merchandising.
Figure 3A:
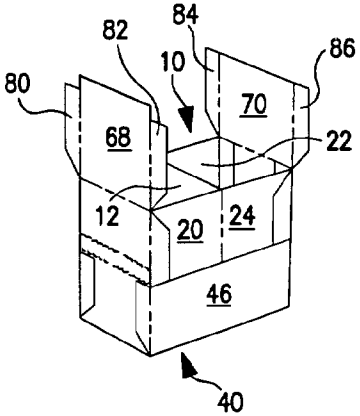
FIG. 3*a* is a perspective view of a container according to one embodiment of the invention, after discharge from the erecting machinery, and possibly prior to product loading (or possibly after), and prior to closure of the top.
Figure 3D:
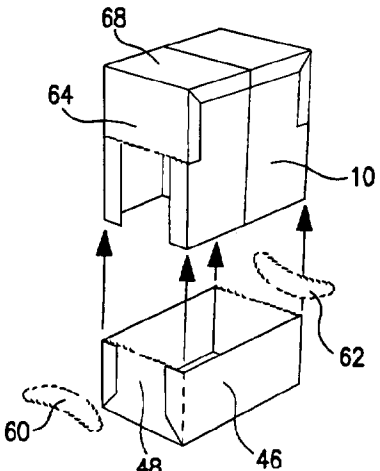
FIG. 3*d* is a perspective view of a container according to FIGS. 3*a*–3*c* being converted for 360° shopping.

Referring to FIG. 3*d*, appropriate application of adhesive will allow a large percentage of the wrap material to be adhered to the interior support, but not glued at all in other areas. Through simple hand application of tear strips, the upper portion of the wrap and the adhered internal support structure can be drawn off as a single piece.

Referring to FIG. 3*b* also, internal flanges 26, 28, 30 and 32 are preferably only spot adhered or not at all to side wall wrap sections 64 and 66 (FIG. 3*d*). This gluing preferably should only take place on the internal support flanges 26, 28, 30 and 32 at a point above the tear strip 60 and 62 locations. It may be desired with some applications to have the flanges adhered at these locations, while other product applications may not require such a level of structural support.

FIGS. 4–17 illustrate alternative embodiments of either the interior vertical support structure and/or the outer wrap.

In the illustrations, those components, which are of particular interest, as having been modified from the basic embodiment of FIGS. 1 through 3*a*–3*e*, are denoted by like reference numerals as the counterpart components of the basic embodiment, augmented by a letter.

Figure 4:
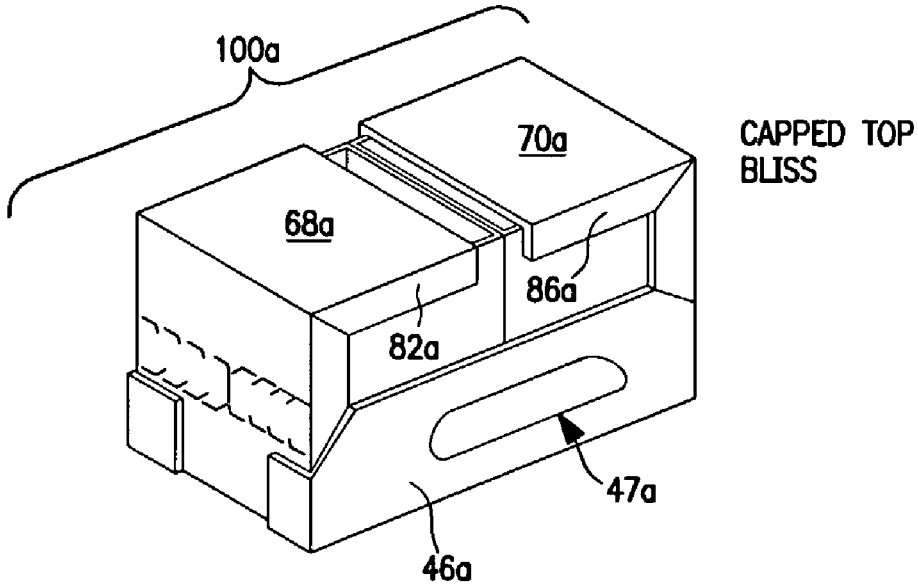
FIG. 4 is a perspective view of an alternative embodiment of the invention, wherein the top portion of the wrap is provided with shortened top panels, to expose a portion of the top area of the container.

FIG. 4 is a perspective view of an alternative embodiment of the invention, wherein the top portion of the wrap is provided with shortened top panels, to expose a portion of the top area of the container. Specifically, top panels 68*a* and 70*a* are shortened, as are flanges 82*a* and 86*a* and the corresponding flanges (not shown, but present) on the rear side of assembly 100*a*. In addition, the embodiment of FIG. 4 may be provided with one or more punchouts defined by perforations 47*a*, in sidewall 46*a* and its counterpart (not shown, but present) on the rear side of assembly 100*a*. These punchouts are adhesively affixed to adjoining surfaces of whatever internal support structure is used. To open the container, the punchouts are pushed through (i.e., toward the tray interior), leaving a tray with newly formed hand holes. The punchouts remain affixed to the support structure.

Figure 5:
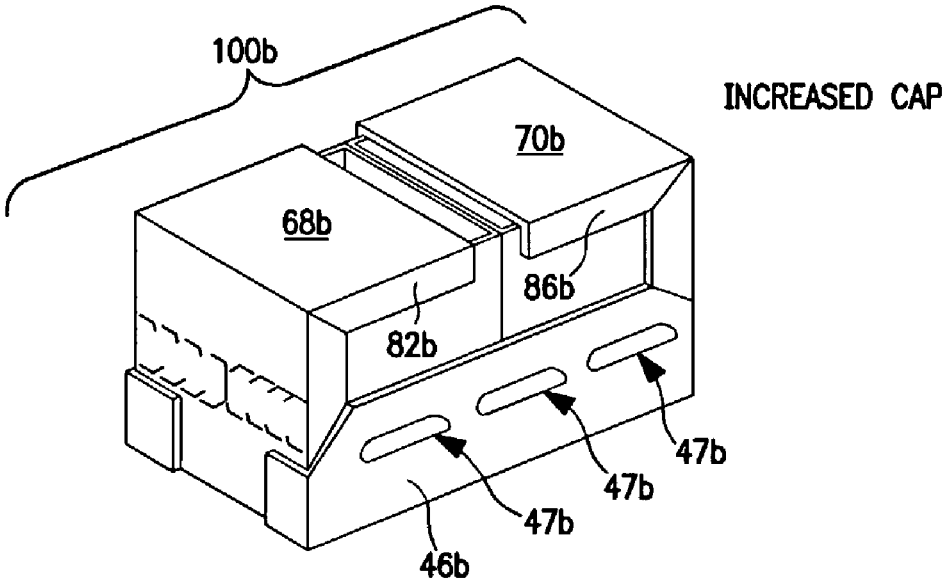
FIG. 5 is a perspective view of a further alternative embodiment of the invention, wherein the top portion of the wrap is provided with even more shortened top panels, to expose a portion of the top area of the container.

FIG. 5 is a perspective view of a further alternative embodiment of the invention, wherein the top portion of the wrap is provided with even more shortened top panels, to expose a portion of the top area of the container. Specifically, top panels 68*b* and 70*b* are shortened, as are flanges 82*b* and 86*b* and the corresponding flanges (not shown, but present) on the rear side of assembly 100*b*. In addition, the embodiment of FIG. 5 may be provided with one or more punchouts defined by perforations 47*b*, in sidewall 46*b* and its counterpart (not shown, but present) on the rear side of assembly 100*b*. These punchouts are adhesively affixed to adjoining surfaces of whatever internal support structure is used. To open the container, the punchouts are pushed through (i.e., toward the tray interior), leaving a tray with newly formed hand holes. The punchouts remain affixed to the support structure.

Figure 6:
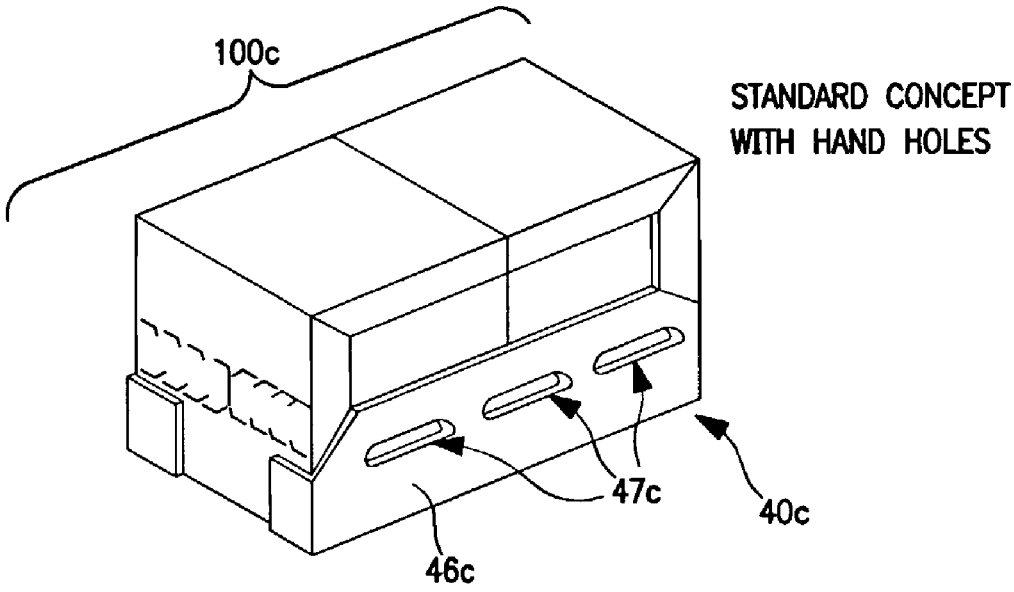
FIG. 6 is a perspective view of a further alternative embodiment of the invention, namely, a variation of the embodiment of FIGS. 1–3*e*, having hand holes in the sidewalls of the bottom portion of the outer wrap.

FIG. 6 is a perspective view of a further alternative embodiment of the invention, namely, a variation of the embodiment of FIGS. 1–3*e*, having punchouts defined by perforations 47*c* in the sidewalls (e.g., sidewall 46*c*) of the bottom portion of the outer wrap 40*c*. These punchouts are adhesively affixed to adjoining surfaces of whatever internal support structure is used. To open the container, the punchouts are pushed through (i.e., toward the tray interior), leaving a tray with newly formed hand holes. The punchouts remain affixed to the support structure.

Figure 7:
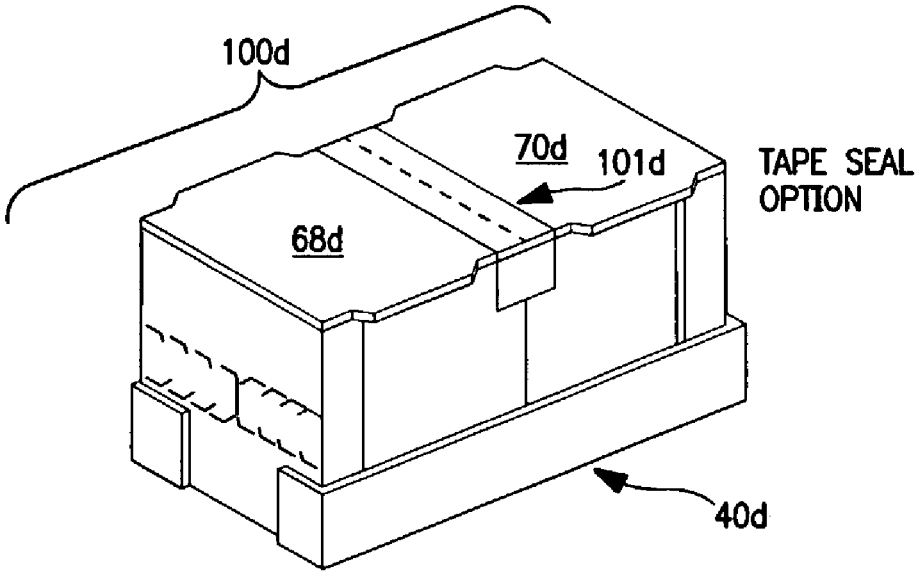
FIG. 7 is a perspective view of a further alternative embodiment of the invention, in which a tape seal is employed to enhance the closure of the top panel members of the outer wrap.

FIG. 7 is a perspective view of a further alternative embodiment 100*d* of the invention, in which a tape seal 101*d* is employed to provide the closure of the top panel members 68*d*, 70*d* of the outer wrap 40*d*, inasmuch as no top flanges (such as flanges 82, 84, 86 and 88 of FIG. 2) are provided.

Figure 8:
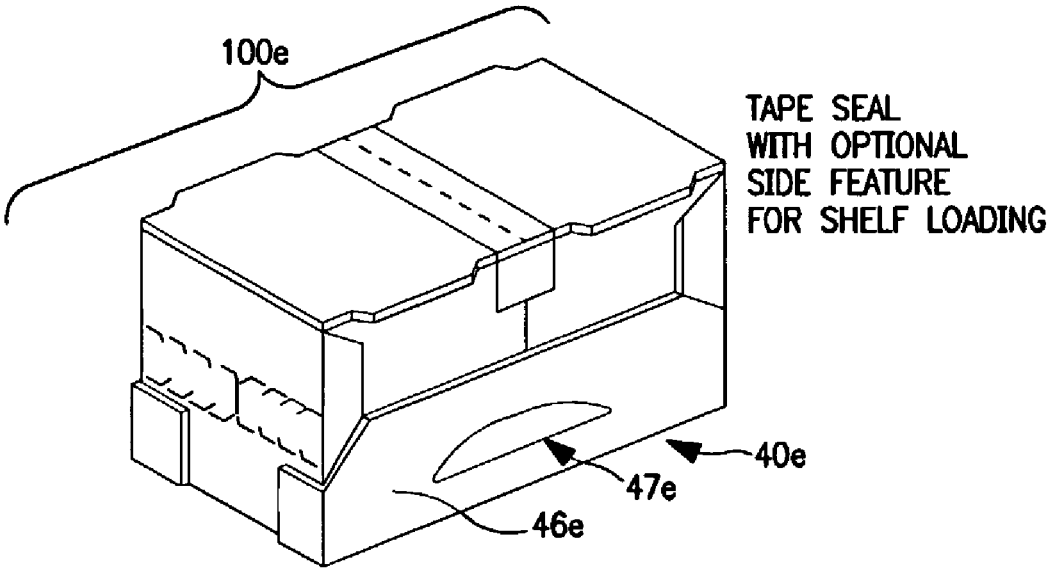
FIG. 8 is a perspective view of a variation of the alternative of the embodiment of FIG. 7, including hand holes in the sidewalls of the bottom portion of the outer wrap.

FIG. 8 is a perspective view of a variation 100*e* of the alternative of the embodiment of FIG. 7, including punchouts defined by perforations 47*e* in the sidewalls of the bottom portion of the outer wrap 40*e*. These punchouts are adhesively affixed to adjoining surfaces of whatever internal support structure is used. To open the container, the punchouts are pushed out; leaving a tray with newly formed hand holes. The punchouts remain affixed to the support structure.

Figure 9:
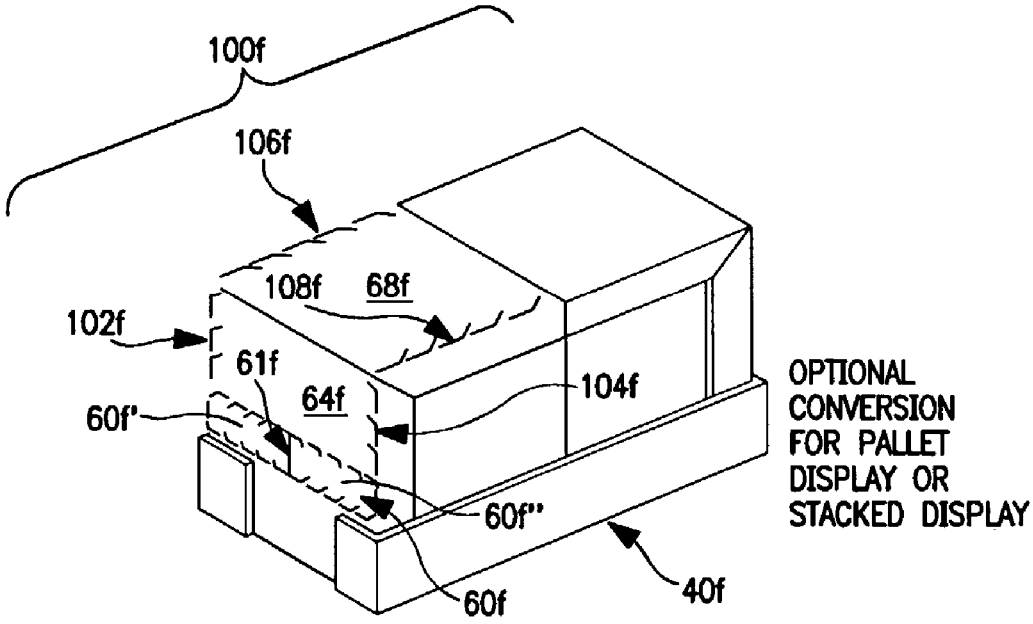
FIG. 9 is a perspective view of a further alternative embodiment of the invention, wherein the outer wrap is provided with a side tear strip on one end of the container, and further including lines of weakness for enabling removal of one top panel and one upper end wall, only, leaving one top panel and one end wall in place.

FIG. 9 is a perspective view of a further alternative embodiment 100*f* of the invention, wherein the outer wrap 40*f* is provided with a side tear strip 60*f* on one end of the container, and further including lines of weakness 102*f*, 104*f*, 106*f*, 108*f* for enabling removal of one top panel 68*f* and one upper end wall 64*f*, only, leaving one top panel 70*f* and one end wall (not shown but present) in place.

Figure 10:
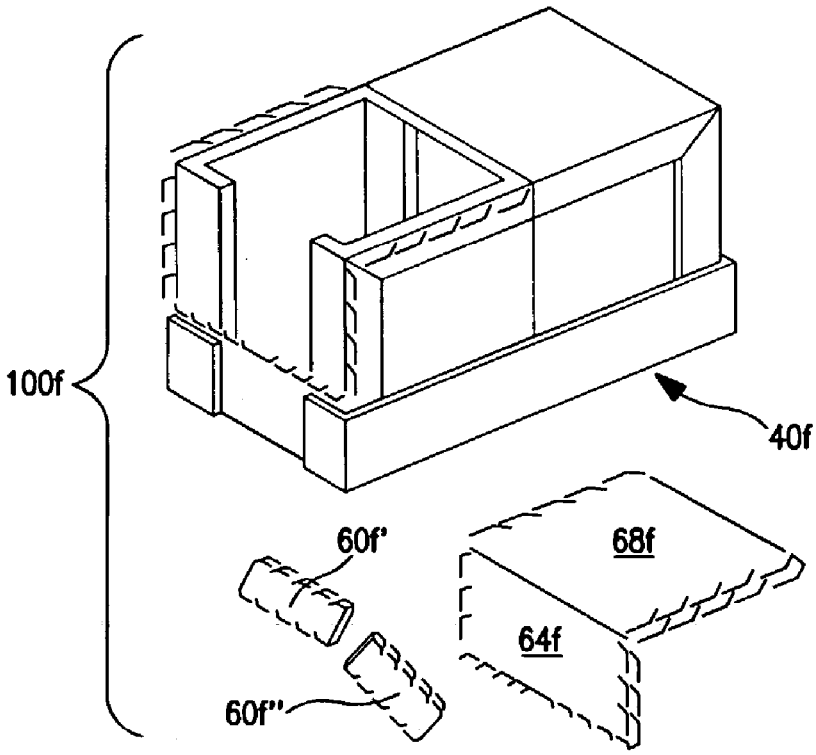
FIG. 10 is a perspective view of the embodiment of FIG. 9, wherein one tearstrip and one top panel and end wall combination have been removed.

FIG. 10 is a perspective view of the embodiment of FIG. 9, wherein one tearstrip and one top panel and end wall combination have been removed.

Figure 11:
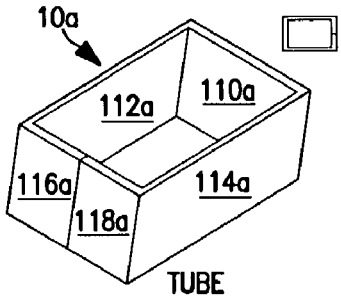
FIG. 11 is a perspective view of an alternative embodiment of the interior support structure for a convertible container according to the present invention, in the form of a simple tube, with a reduced scale top plan view adjacent thereto.
Figure 18:
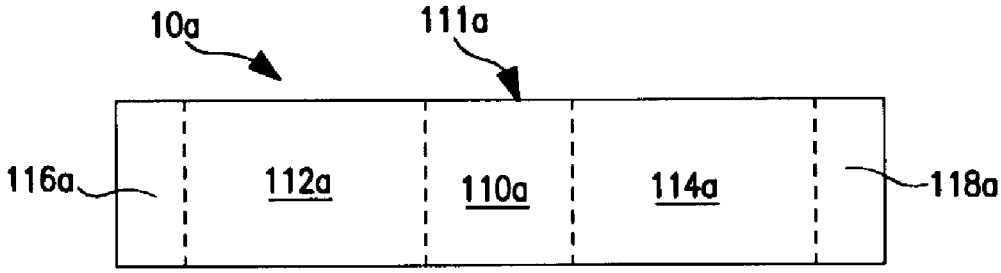
FIG. 18 is a plan view of a blank for forming the interior support structure shown in FIG. 11.

FIG. 11 is a perspective view of an alternative embodiment of the interior support structure 10*a* for a convertible container according to the present invention, in the form of a simple tube. FIG. 18 is a plan view of a blank, according to one embodiment of the invention, for forming the interior support structure shown in FIG. 11. Blank 10*a*, as shown in FIG. 18, may include back panel 110*a*; side panels 112*a*, 114*a*; and front panels 116*a*, 118*a*. As in the other embodiments, blank 10*a* may be fabricated from any suitable paper, paperboard and/or corrugated paperboard material, of any suitable strength and thickness as desired. Blank 10*a* may be double-ply. Alternatively, a double thickness may be obtained, by providing a double sized blank, that would comprise two blanks 10*a*, as shown, arranged side-by-side, and connected along a fold line that would be placed where side edge 111*a* is in FIG. 18.

Figure 12:
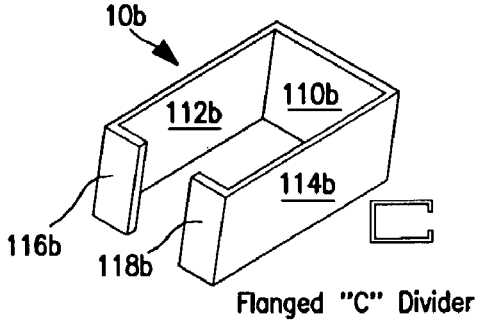
FIG. 12 is a perspective view of an alternative embodiment of the interior support structure for a convertible container according to the present invention, in the form of "C"-shape, with a reduced scale top plan view adjacent thereto.
Figure 19:
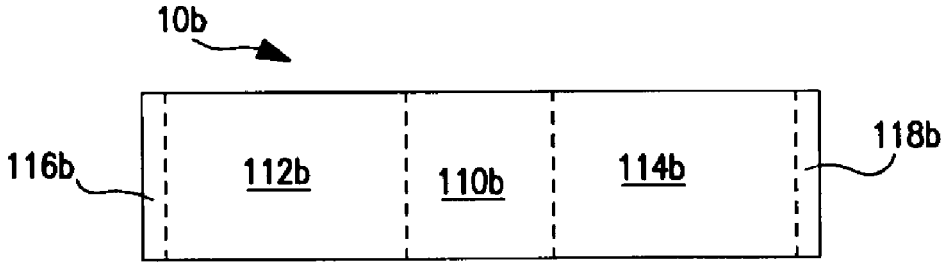
FIG. 19 is a plan view of a blank for forming the interior support structure shown in FIG. 12.

FIG. 12 is a perspective view of an alternative embodiment of the interior support structure for a convertible container according to the present invention, in the form of "C"-shape. FIG. 19 is a plan view of a blank, according to one embodiment of the invention, for forming the interior support structure shown in FIG. 12. Blank 10*b* is substantially similar to the construction of blank 10*a*, and may be similarly constituted and varied, except that front panels 116*a*, 118*a* of FIG. 11 have been shortened to provide flanges that give the erected interior vertical support structure a "C"-shape.

Figure 13:
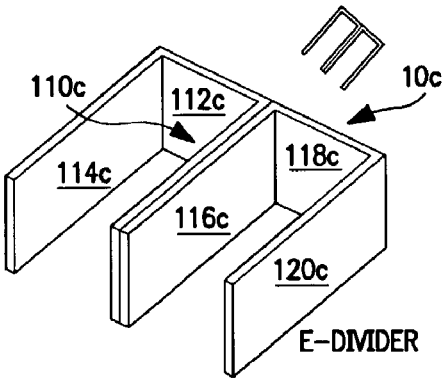
FIG. 13 is a perspective view of an alternative embodiment of the interior support structure for a convertible container according to the present invention, in the form of an "E"-shape, with a reduced scale top plan view adjacent thereto.
Figure 20:
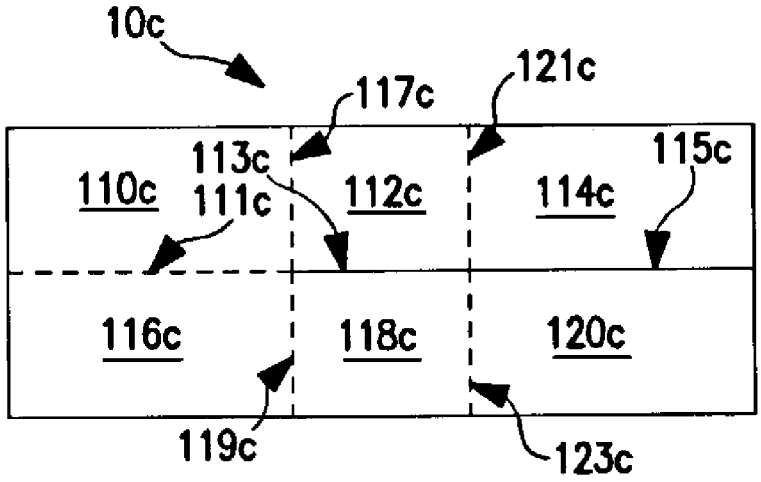
FIG. 20 is a plan view of a blank for forming the interior support structure shown in FIG. 13.

FIG. 13 is a perspective view of an alternative embodiment of the interior support structure for a convertible container according to the present invention, in the form of an "E"-shape. FIG. 20 is a plan view of a blank, according to one embodiment of the invention, for forming the interior support structure shown in FIG. 13. Blank 10*c* may be constructed from the same materials as described with respect to the embodiments of FIGS. 11 and 12, and may be varied as to material, thickness and numbers of layers as may be desired. Blank 10*c* is provided with center panels 110*c*, 116*c*, joined along fold line 111*c*. Rear panels 112*c*, 118*c* emanate from center panels 110*c*, 116*c*, respectively, along fold lines 117*c*, 119*c*. Side panels 114*c*, 120*c* emanate from rear panels 112*c*, 118*c*, respectively, along fold lines 121*c*, 123*c*. To erect interior vertical structural support 10*c*, panels 110*c*, 116*c* are folded about line 111*c* and preferably adhesively affixed to one another. Subsequent right angle folds around fold lines 117*c*, 119*c*, 121*c* and 123*c*, result in the configuration shown in FIG. 13.

Figure 14:
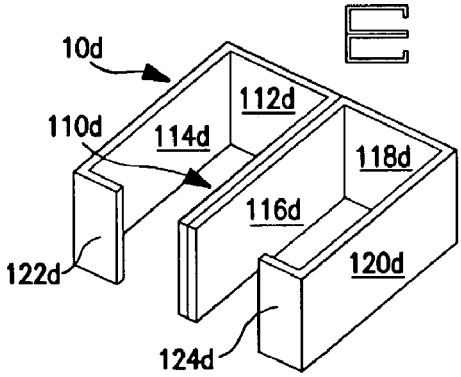
FIG. 14 is a perspective view of an alternative embodiment of the interior support structure for a convertible container according to the present invention, in the form of a flanged "E"-shape, with a reduced scale top plan view adjacent thereto.
Figure 21:
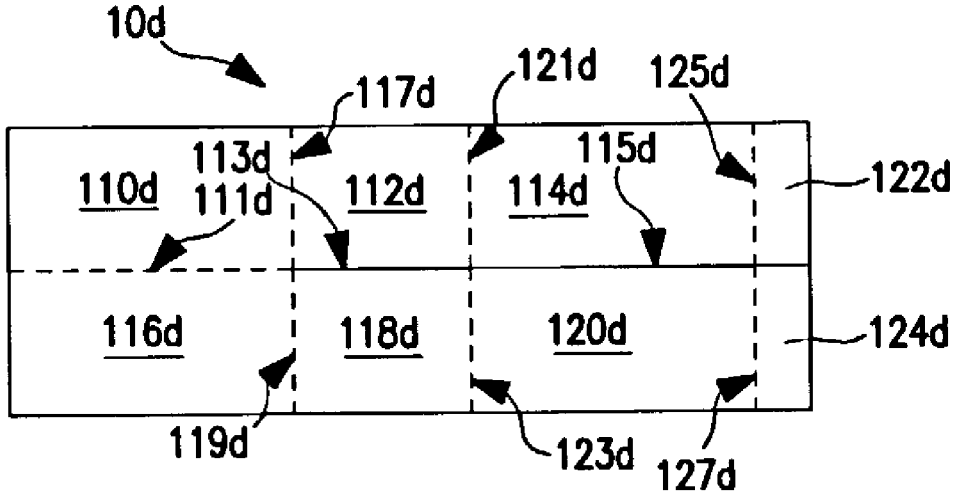
FIG. 21 is a plan view of a blank for forming the interior support structure shown in FIG. 14.

FIG. 14 is a perspective view of an alternative embodiment of the interior support structure for a convertible container according to the present invention, in the form of a flanged "E"-shape. FIG. 21 is a plan view of a blank, according to one embodiment of the invention, for forming the interior support structure shown in FIG. 14. Blank 10*d* may be constructed from the same materials as described with respect to the embodiments of FIG. 13 and may be varied as to material, thickness and numbers of layers as may be desired. Blank 10*d* is provided with center panels 110*d*, 116*d*, joined along fold line 111*d*. Rear panels 112*d*, 118*d* emanate from center panels 110*d*, 116*d*, respectively, along fold lines 117*d*, 119*d*. Side panels 114*d*, 120*d* emanate from rear panels 112*d*, 118*d*, respectively, along fold lines 121*d*, 123*d*. Flanges 122*d*, 124*d* emanate from side panels 114*d*, 120*d*, respectively, along fold lines 125*d*, 127*d*, and are separated by cut 129*d*. To erect interior vertical structural support 10*d*, panels 110*d*, 116*d* are folded about line 111*d* and preferably adhesively affixed to one another. Subsequent right-angle folds around fold lines 117*d*, 119*d*, 121*d*, 123*d*, 125*d* and 127*d*, result in the configuration shown in FIG. 14.

Figure 15:
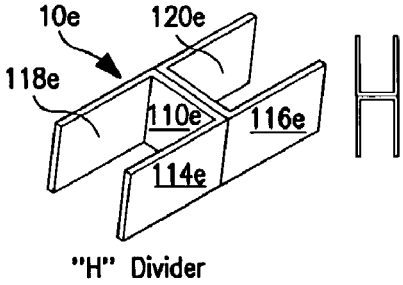
FIG. 15 is a perspective view of an alternative embodiment of the interior support structure for a convertible container according to the present invention, in the form of a simple "H"-shape, with a reduced scale top plan view adjacent thereto.
Figure 22:
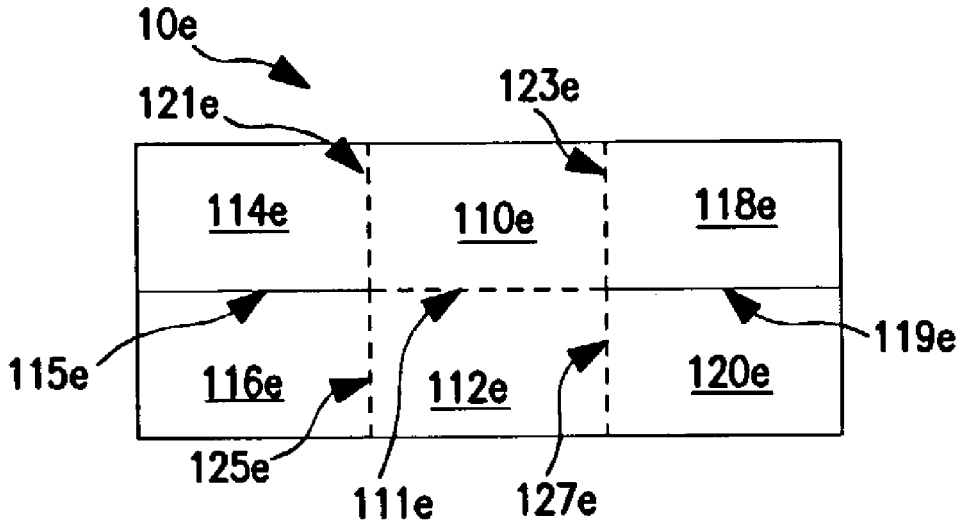
FIG. 22 is a plan view of a blank for forming the interior support structure shown in FIG. 15.

FIG. 15 is a perspective view of an alternative embodiment of the interior support structure for a convertible container according to the present invention, in the form of a simple "H"-shape. FIG. 22 is a plan view of a blank, according to one embodiment of the invention, for forming the interior support structure shown in FIG. 15. Blank 10*e*, which may be constructed from the same variety and variation of materials, as described hereinabove comprises center panels 110*e*, 112*e*, joined by fold line 111*e*. Leg panels 114*e*, 118*e* emanate from center panel 110*e*, along fold lines 121*e*, 123*e*, respectively. Leg panels. 116*e*, 120*e* emanate from center panel 112*e*, along fold lines 125*e*, 127*e*, respectively. Panels 114*e* and 116*e* are separated by cut 115*e*, and panels 118*e* and 120*e* are separated by cut 119*e*. To form the interior vertical support structure, panels 114*e* and 116*e* are folded about fold line 115*e*, juxtaposed to one another and preferably adhesively affixed. Subsequent right angle folds about fold lines 121*e*, 123*e*, 125*e* and 127*e*, result in the configuration shown in FIG. 15.

Figure 16:
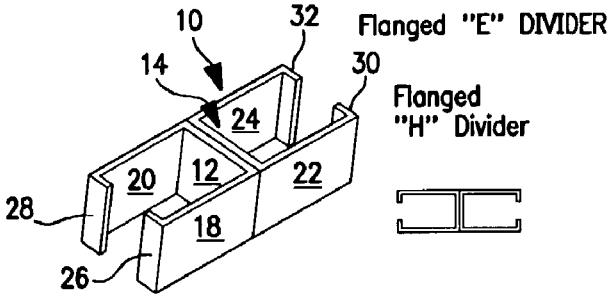
FIG. 16 is a further perspective view of an embodiment of the interior support structure for a convertible container according to the present invention, in the form of a flanged "H"-shape, as shown in the embodiment of FIGS. 1–3, with a reduced scale top plan view adjacent thereto.

FIG. 16 is a further perspective view of an embodiment of the interior support structure for a convertible container according to the present invention, in the form of a flanged "H"-shape, as shown in the embodiment of FIGS. 1–3*e*.

Figure 17:
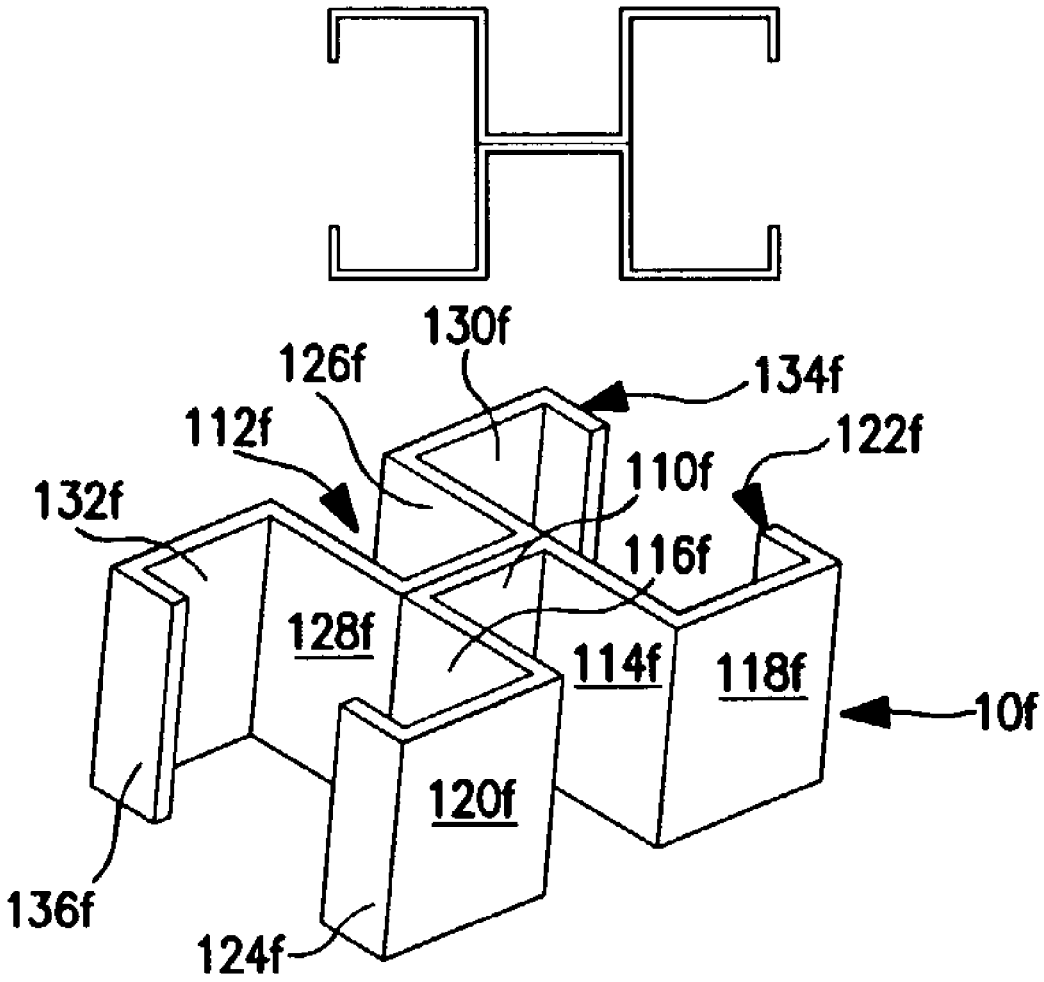
FIG. 17 is a perspective view of an alternative embodiment of the interior support structure for a convertible container according to the present invention, in the form of two spaced-apart "C"-shapes joined by a web, with a reduced scale top plan view adjacent thereto.
Figure 23:
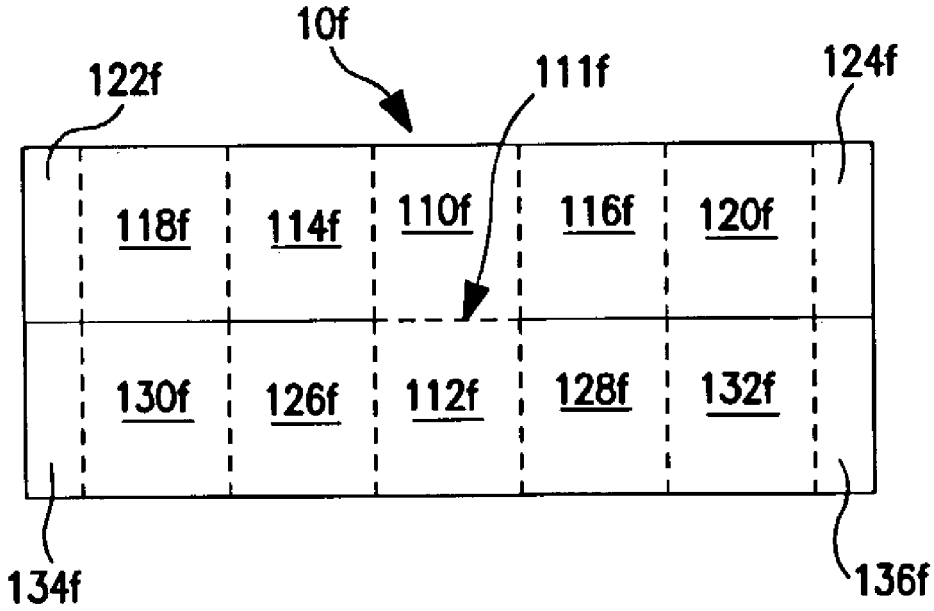
FIG. 23 is a plan view of a blank for forming the interior support structure shown in FIG. 17.

FIG. 17 is a perspective view of an alternative embodiment of the interior support structure for a convertible container according to the present invention, in the form of two spaced-apart "C"-shapes joined by a web. FIG. 23 is a plan view of a blank, fabricated from the usual materials, as discussed herein elsewhere, for forming the interior support structure shown in FIG. 17. Blank 10*f* comprises center panels 110*f* and 112*f*, joined along fold line 111*f*. Panels 114*f*, 116*f*, emanate from center panel 110*f*, along fold lines as indicated by the broken lines. Panels 118*f*, 120*f*, emanate from panels 114*f*, 116*f*, respectively. Flanges 122*f*, 124*f*, emanate from panels 118*f*, 120*f*, respectively. Panels 126*f*, 128*f*, emanate from center panel 112*f*, along fold lines as indicated by the broken lines. Panels 130*f*, 132*f*, emanate from panels 126*f*, 128*f*, respectively. Flanges 134*f*, 136*f*, emanate from panels 130*f*, 132*f*, respectively. To form the interior vertical support structure, panels 110*f* and 112*f* are folded about fold line 111*f*, juxtaposed to one another and preferably adhesively affixed. Subsequent right angle folds of the various panels, about the various fold lines (indicated by the broken lines), result in the configuration shown in FIG. 17.

Figure 24:
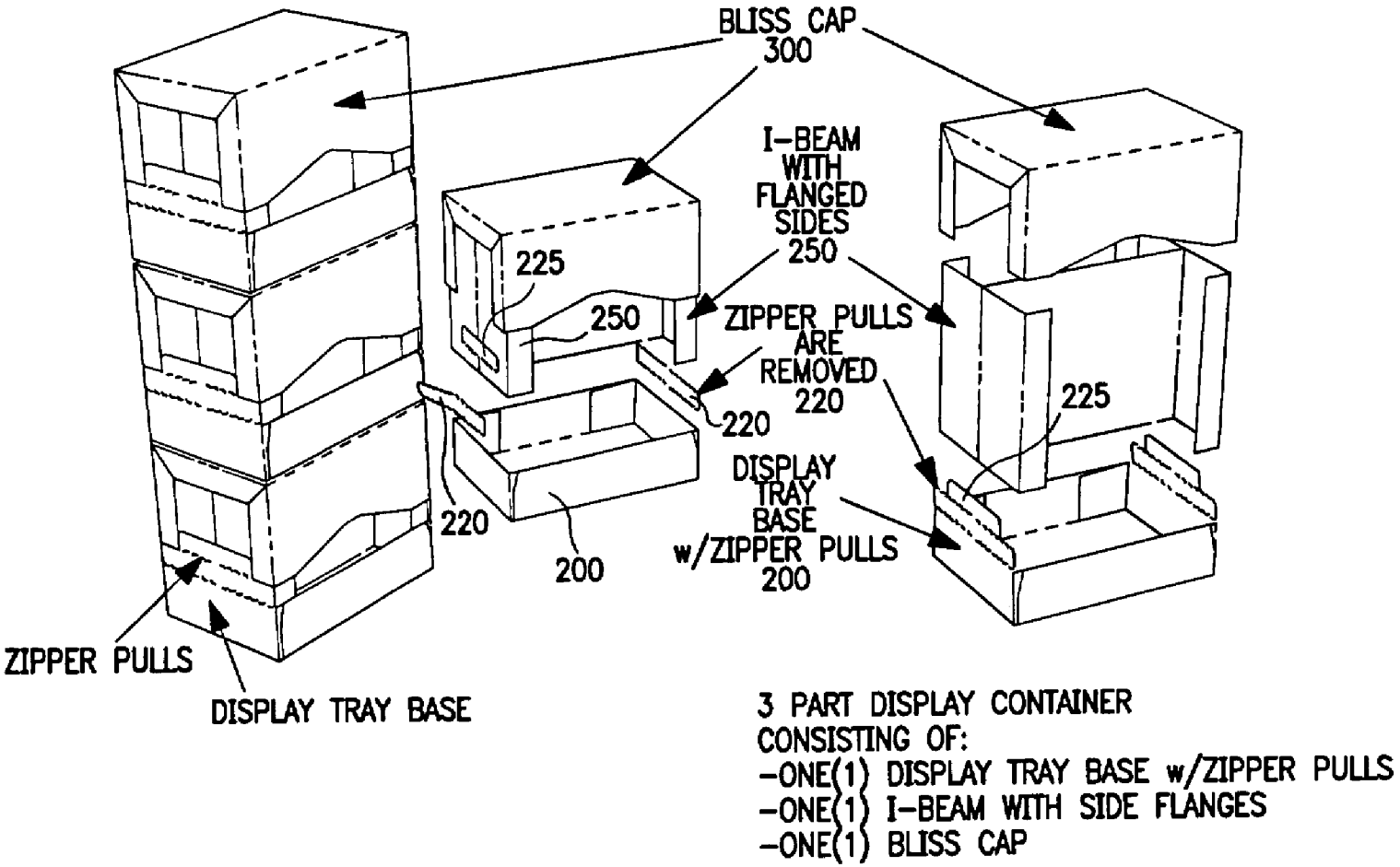
FIG. 24 is a perspective view of an alternative embodiment of the invention, incorporating a three-piece construction.
Figure 25:
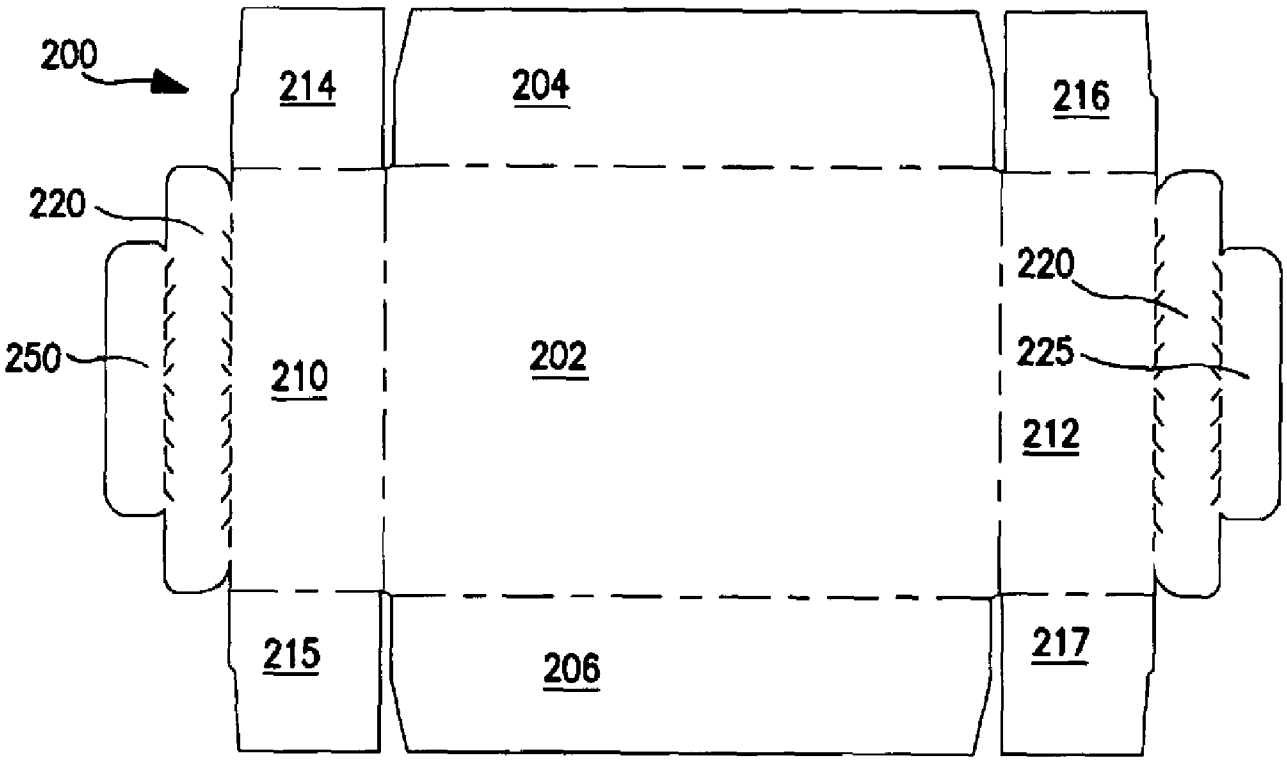
FIG. 25 is a plan view of a blank for a tray for use in the embodiment of FIG. 24.

FIG. 24 is a perspective view of an alternative embodiment of the invention, incorporating a three-piece construction. In the three-piece construction, a tray is formed, from a blank as shown in FIG. 25. A divider for the product, which also serves as the vertical support structure, is formed, from a blank as shown in FIG. 27. Finally, a Bliss-style cap is placed on top and adhesively affixed from the blank shown in FIG. 26.

Referring to the right-hand side of FIG. 24, tray 200 is provided with zipper type tear strips 220, and tabs 225. The divider/vertical support structure 250 is inserted and strategically adhered to the tray during mechanical erecting. Bliss-type cap 300 is placed on top of support structure 250, and adhesively affixed thereto. Opening of the container is accomplished by tearing the tear strips 220 (which are not adhesively affixed to the adjacent ends of the support structure 250), as shown in the left side of FIG. 24. Tabs 225 remain in place, and cap 300 and support structure 250 may be lifted together in their entirety, off of the remaining portions of tray 200, leaving a 360-degree shoppable display tray.

FIG. 25 is a plan view of a blank for a tray 200 for use in the embodiment of FIG. 24. In addition to tear strips 220 and tabs 250, blank 200 includes bottom 202; sidewalls 204, 206; end walls 210, 212; and minor flaps 214, 215, 216, 217 (to be adhesively affixed to the inside, or outside (a preferred embodiment) surfaces of sidewalls 204, 206). The broken lines indicate the fold lines, and scalloped lines indicate perforations or other cuts for creating lines of weakness. The cap may be provided with perforations along the edges of the top panel, and across the top panel, to enable portions or the entirety of the top panel to be removed to enable access to the interior of the container.

Figure 26:
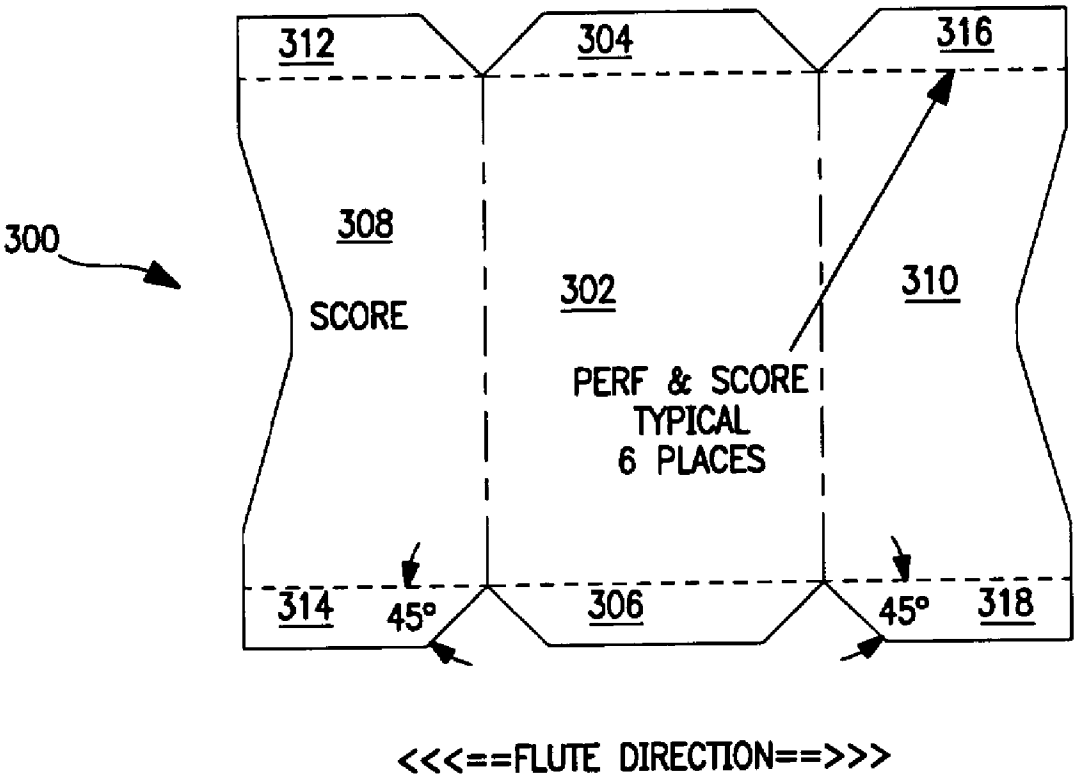
FIG. 26 is a plan view of a blank for a Bliss-style cap for use in the embodiment of FIG. 24.
Figure 27:
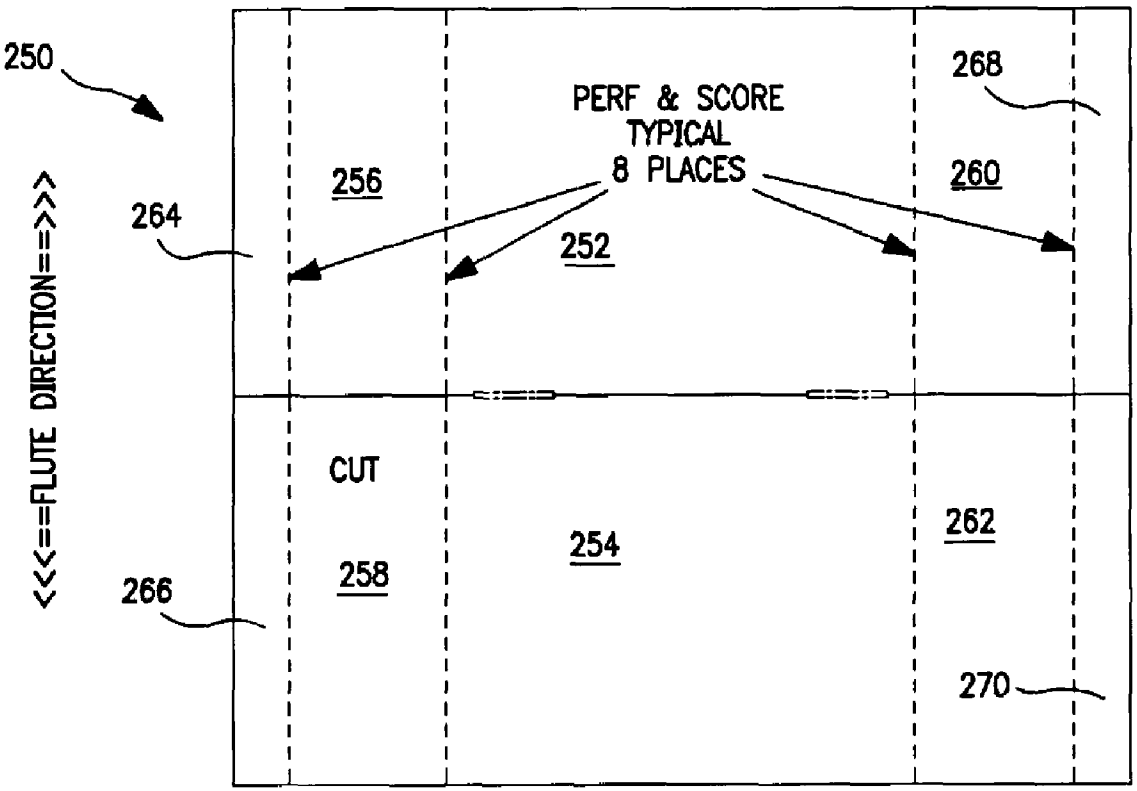
FIG. 27 is a plan view of a blank for an H-divider for use in the embodiment of FIG. 24.

FIG. 26 is a plan view of a blank for a Bliss-style cap for use in the embodiment of FIG. 24. Broken lines indicate fold lines. Blank 300 includes top panel 302; top flanges 304, 306; side panels 308, 310; and side flanges 312, 314, 316, 318 (which will be adhesively affixed to adjacent outside surfaces of support structure 250, as shown in FIG. 24).

FIG. 27 is a plan view of a blank 250 for an H-divider for use in the embodiment of FIG. 24. Broken lines indicate fold lines, while solid lines in the interior of the illustrated blank represent through cuts. Blank 250 includes center panels 252, 254; leg panels 256, 258, 260, 262; and flanges 264, 266, 268, 270. Blank 250 is folded in a manner similar to a similar support structure illustrated and described herein with respect to the two-piece embodiments.

Figure 28:
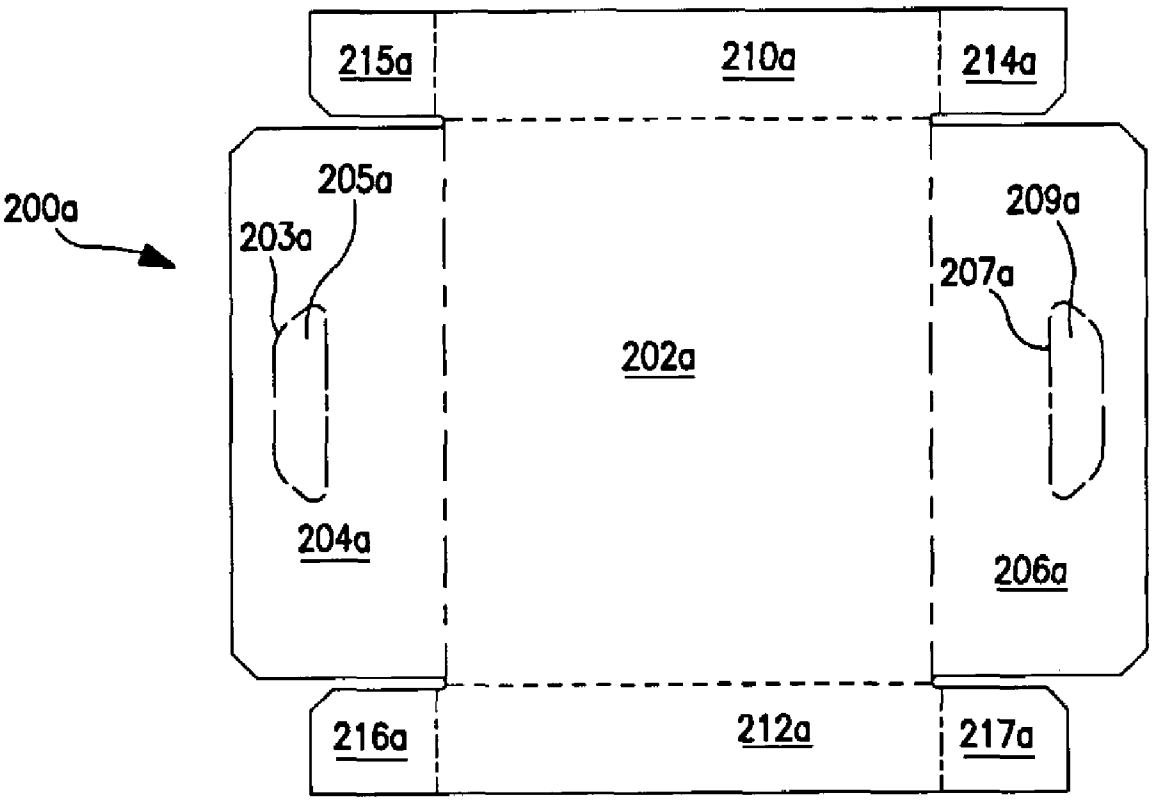
FIG. 28 is a plan view of a blank for an alternative tray construction, for use in the embodiment of FIG. 24.

FIG. 28 is a plan view of a blank for another alternative preferred embodiment of the tray construction, for use in the embodiment of FIG. 24. Elements similar to those of blank 220 are given like reference numerals, with an "a" appended thereto. In this embodiment, instead of tear strips, in sidewalls 204*a* and 206*a*, are provided perforations 203*a*, 207*a*, defining punchouts 205*a*, 209*a*. These punchouts are adhesively affixed to adjoining surfaces of whatever internal support structure is used. To open the container, the punchouts are pushed through (i.e., toward the tray interior), leaving a tray with newly formed hand holes. The punchouts remain affixed to the support structure. FIG. 28 shows a preferred embodiment of the minor flaps for the base tray, as is also shown in FIG. 25. That is, the minor flaps are disposed to the outside, so that firm gluing between the internal support component and the tray wall is possible. Having the minor flaps to the outside allows for flush contact making gluing easier to accomplish.

Figure 29:
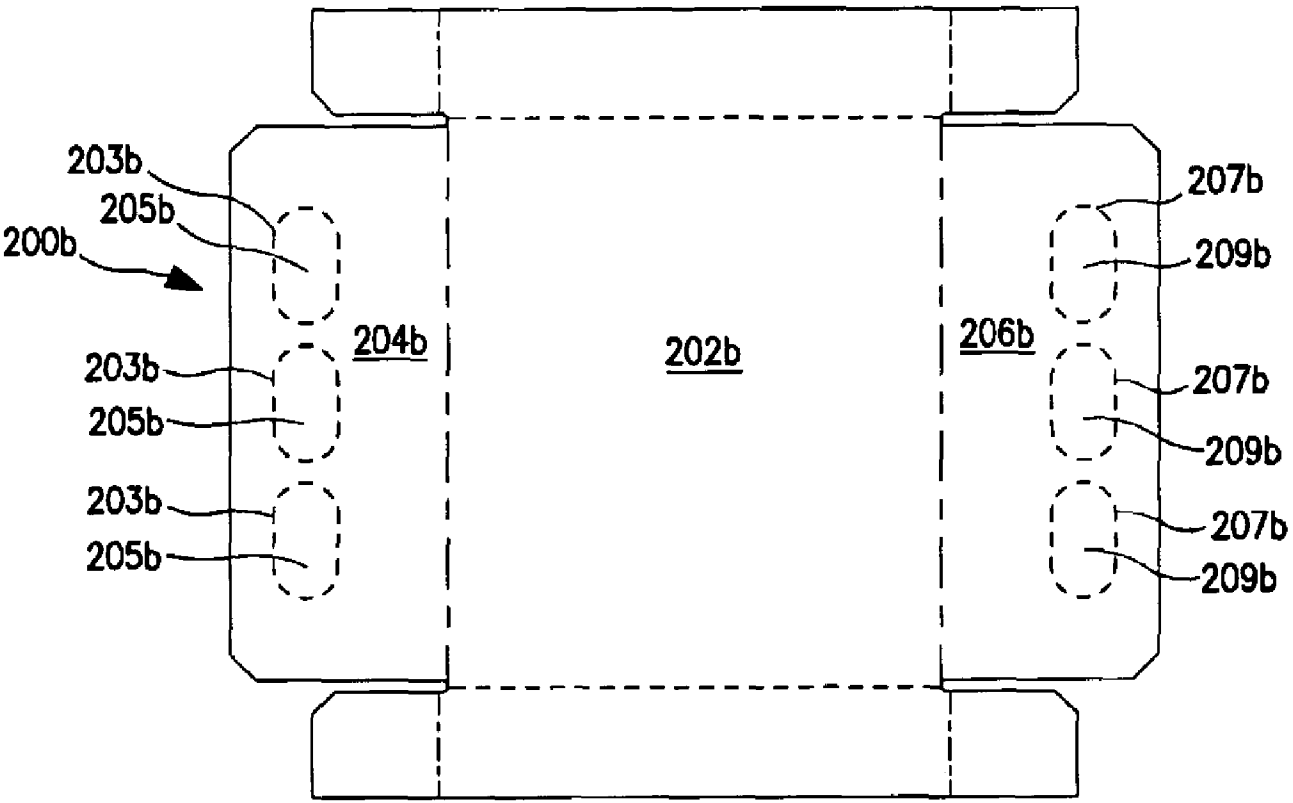
FIG. 29 is a plan view of a blank for an alternative tray construction, for use in the embodiment of FIG. 24.

FIG. 29 is a plan view of a blank for an alternative tray construction 200*b*, for use in the embodiment of FIG. 24. Tray blank 200*b* differs from the embodiment of FIG. 28, in that instead of one punchout per sidewall, there are three punchouts in each sidewall.

Figure 30:
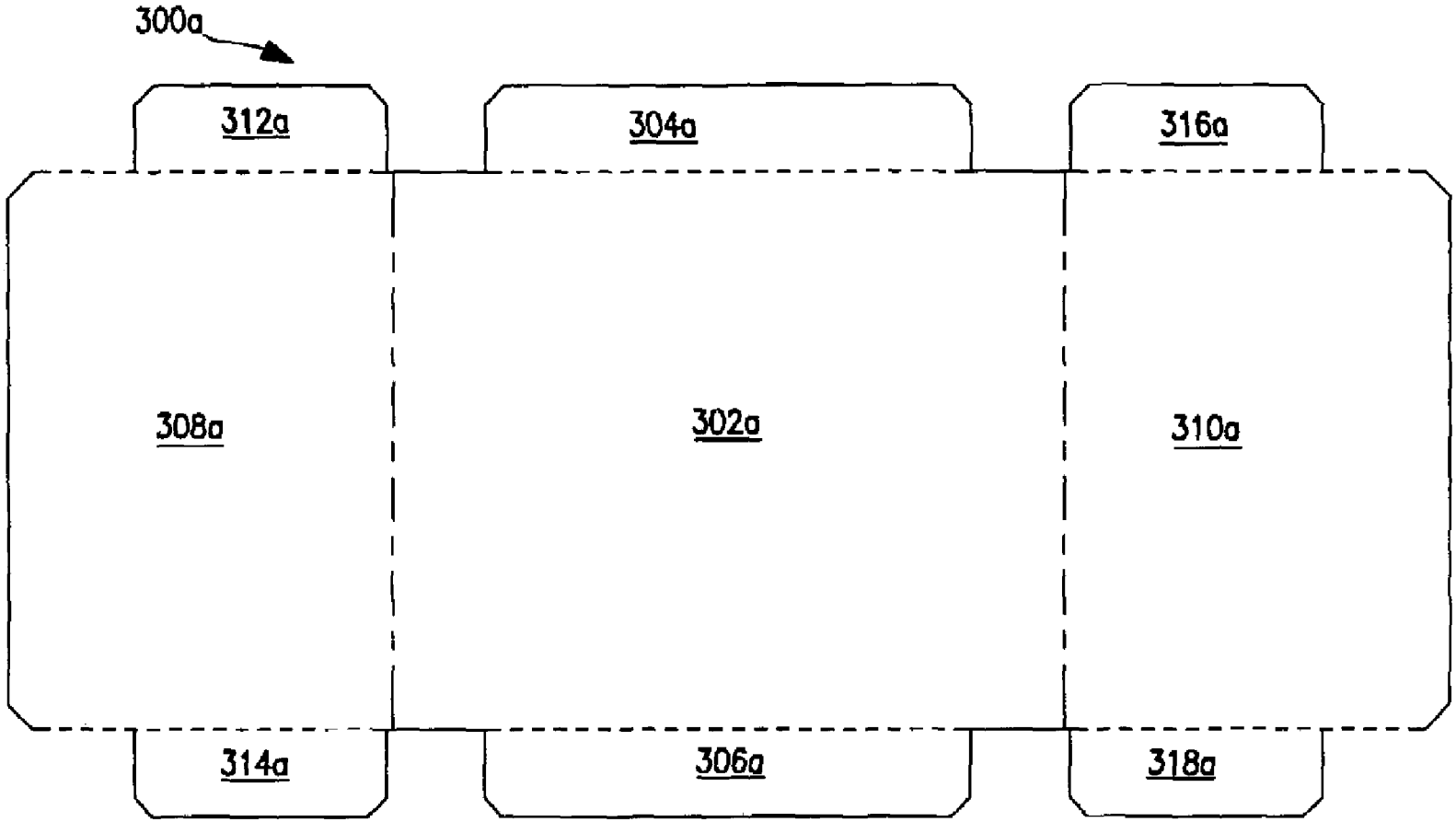
FIG. 30 is a plan view of a blank for an alternative Bliss-style cap for use in the embodiment of FIG. 24.

FIG. 30 is a plan view of a blank for an alternative Bliss-style cap for use in the embodiment of FIG. 24. Broken lines indicate fold lines. Blank 300*a* includes top panel 302*a*; top flanges 304*a*, 306*a*; side panels 308*a*, 310*a*; and side flanges 312*a*, 314*a*, 316*a*, 318*a* (which will be adhesively affixed to adjacent outside surfaces of whatever support structure is used). Instead of the contoured free edges of the side panels, shown in FIG. 26, the free edges of side panels 308*a*, 310*a* are straight.

Figure 31:
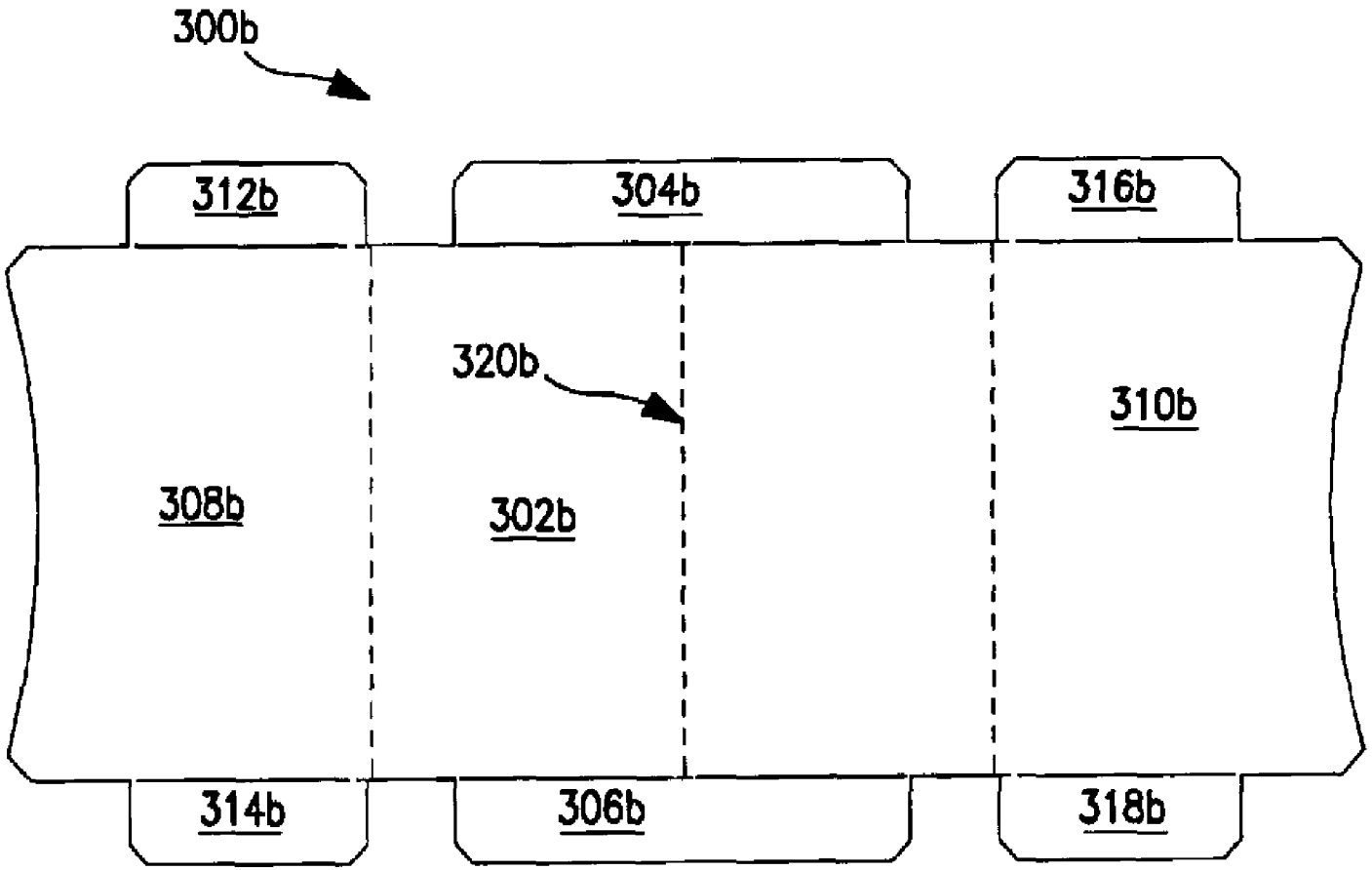
FIG. 31 is a plan view of a blank for an alternative Bliss-style cap for use in the embodiment of FIG. 24.

FIG. 31 is a plan view of a blank for an alternative Bliss-style cap for use in the embodiment of FIG. 24. Broken lines indicate fold lines. Blank 300*b* includes top panel 302*b*; top flanges 304*b*, 306*b*; side panels 308*b*, 310*b*; and side flanges 312*b*, 314*b*, 316*b*, 318*b* (which will be adhesively affixed to adjacent outside surfaces of whatever support structure is used). A perforation 320*b* divides top panel 302*b*, to permit partial opening of the container.

Figure 32:
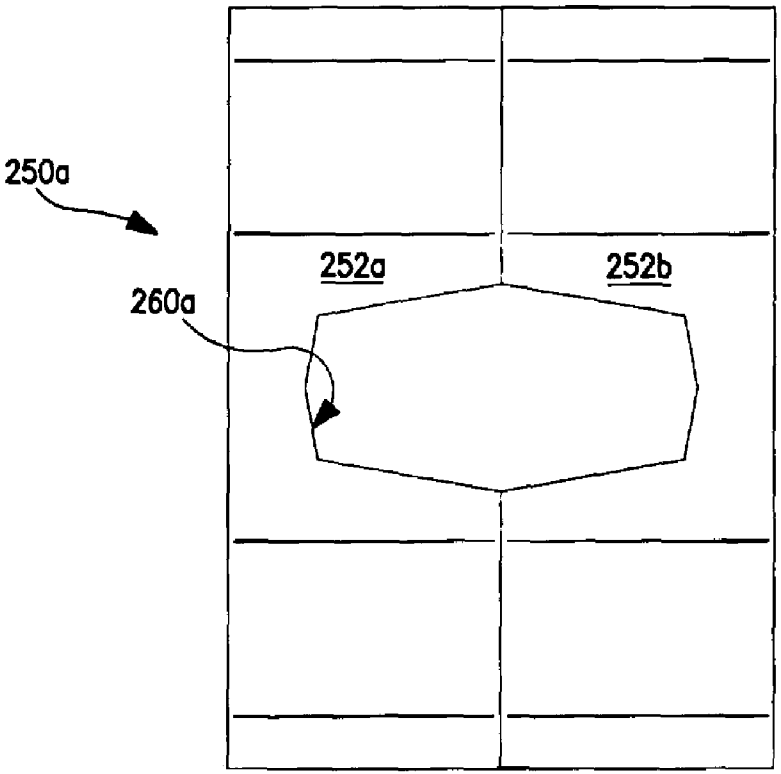
FIG. 32 is a plan view of a blank for an alternative H-divider for use in the embodiment of FIG. 24.

FIG. 32 is a plan view of a blank for an alternative H-divider for use in the embodiment of FIG. 24. Blank 250*a* is essentially functionally the same as blank 250, except that an oblong hole 260*a* is formed in the middle of center panels 252*a*, 254*a*, to define, when the panels are folded together, a "U" or "V" shaped opening or gap in the center of the support structure, which may facilitate access to goods in the interior of the container.

Figure 33:
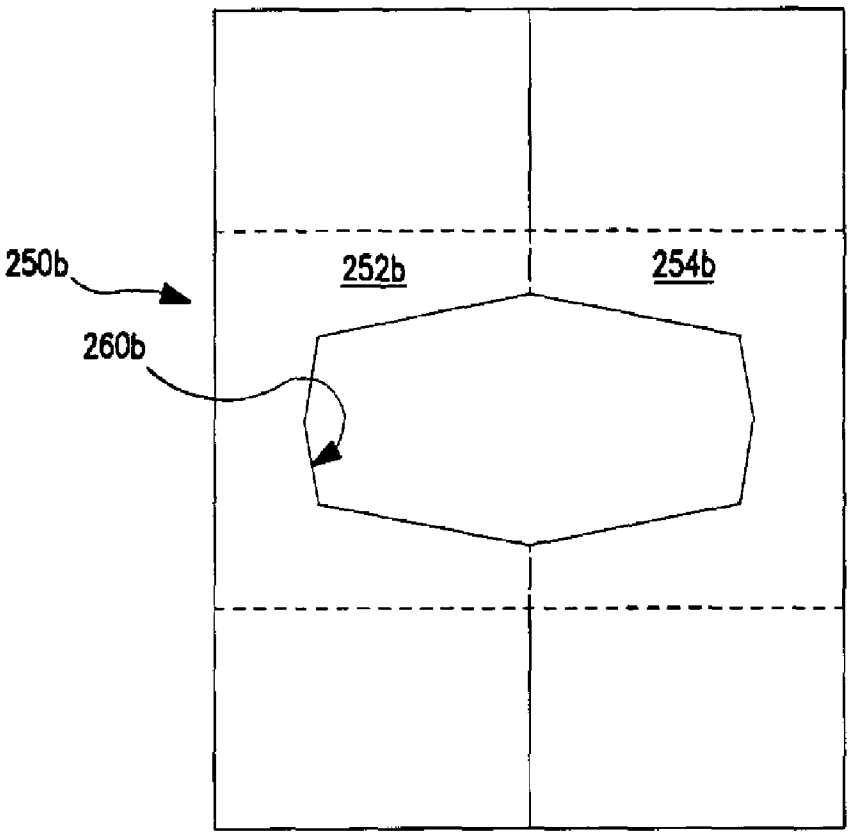
FIG. 33 is a plan view of a blank for an alternative H-divider for use in the embodiment of FIG. 24.
Figure 34:
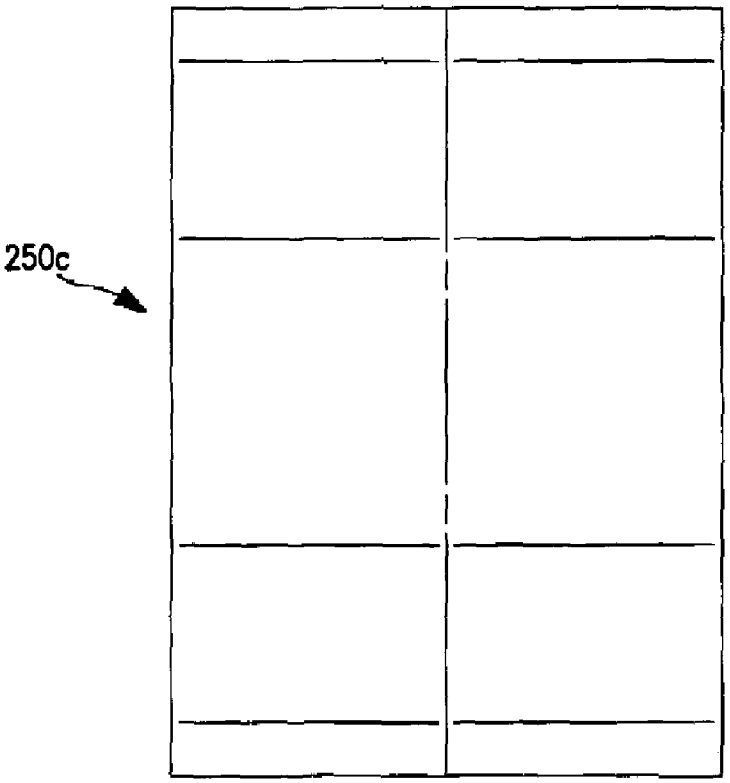
FIG. 34 is a plan view of a blank for an alternative H-divider for use in the embodiment of FIG. 24.

FIG. 33 is a plan view of a blank for an alternative H-divider for use in the embodiment of FIG. 24. Blank 250*b* is essentially the same as blank 250*a*, except that no flanges are provided emanating from the leg panels. FIG. 34 is a plan view of a blank 250*c* for an alternative H-divider for use in the embodiment of FIG. 24.

Figure 35:
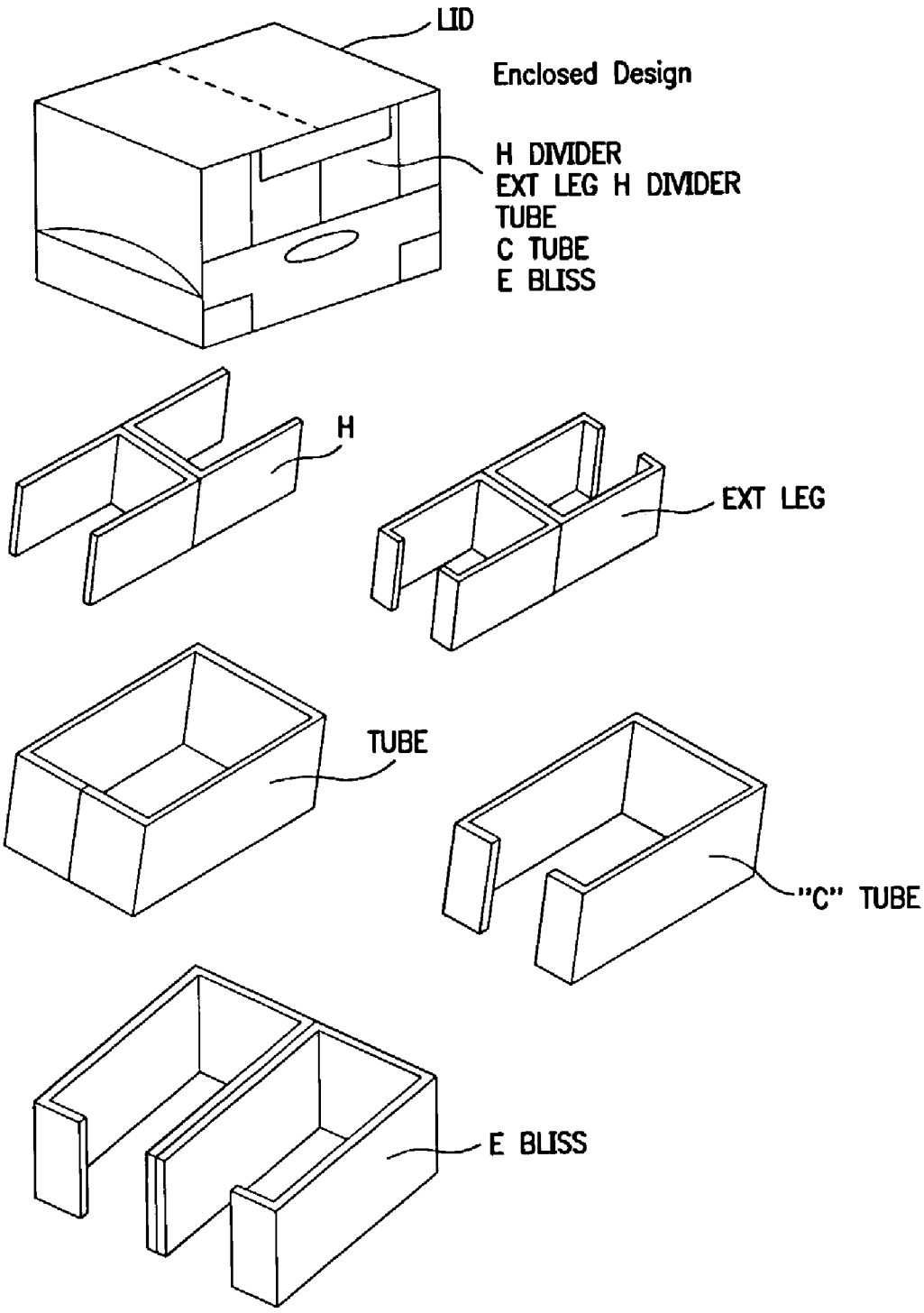
FIG. 35 is a further illustration of the three-piece Bliss-capped convertible shipping display system, with alternative divider/internal vertical support structure configurations.

FIG. 35 is a further illustration of the three-piece Bliss-capped convertible shipping display system, with alternative divider/internal vertical support structure configurations. These alternative support structures may be fabricated from blanks, similar to those illustrated and described with respect to the two-piece convertible shipping container constructions described herein.

Figure 36:
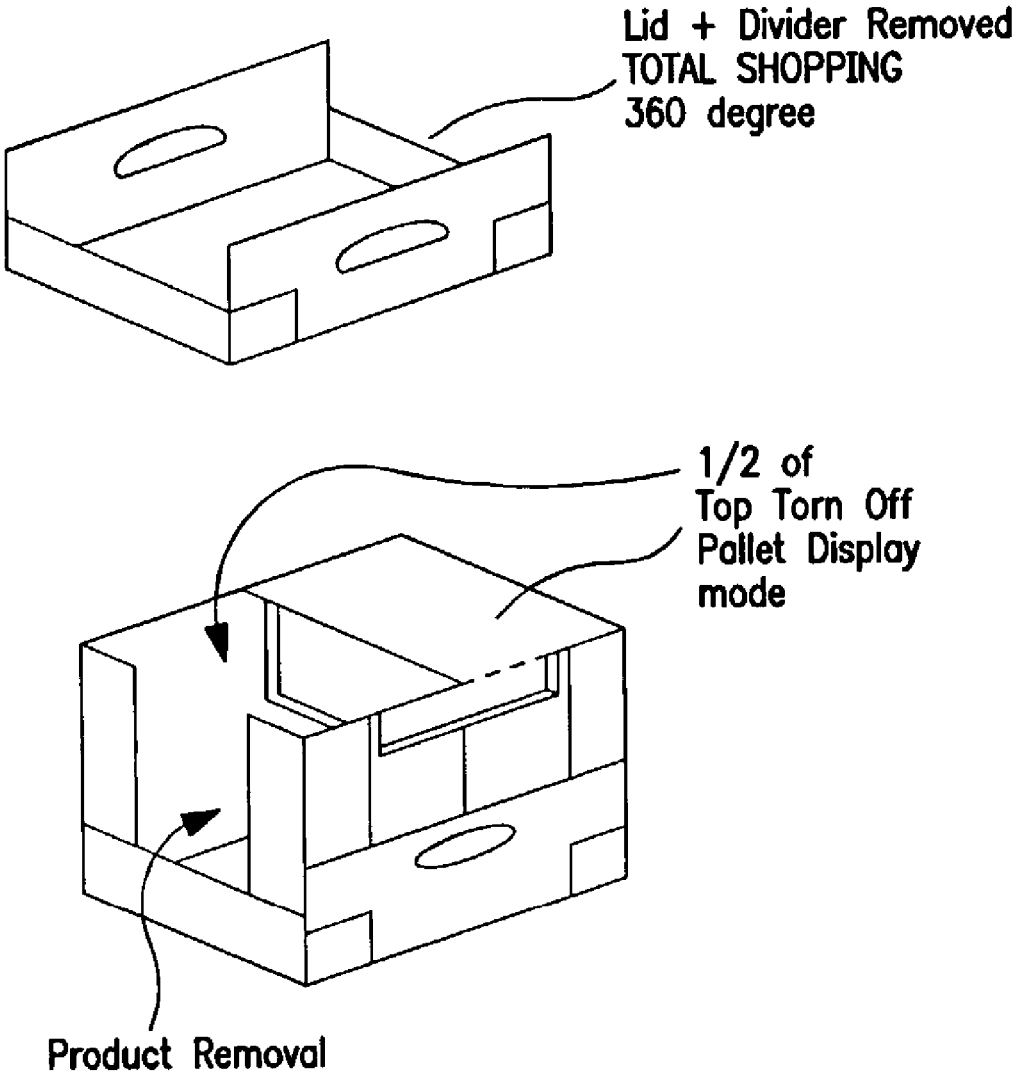
FIG. 36 is a further illustration of the three-piece container system, showing how a container may be partially openable, through advantageous positioning of lines of weakness in the Bliss-style cap, as demonstrated in the two-piece embodiments.
Figure 37:
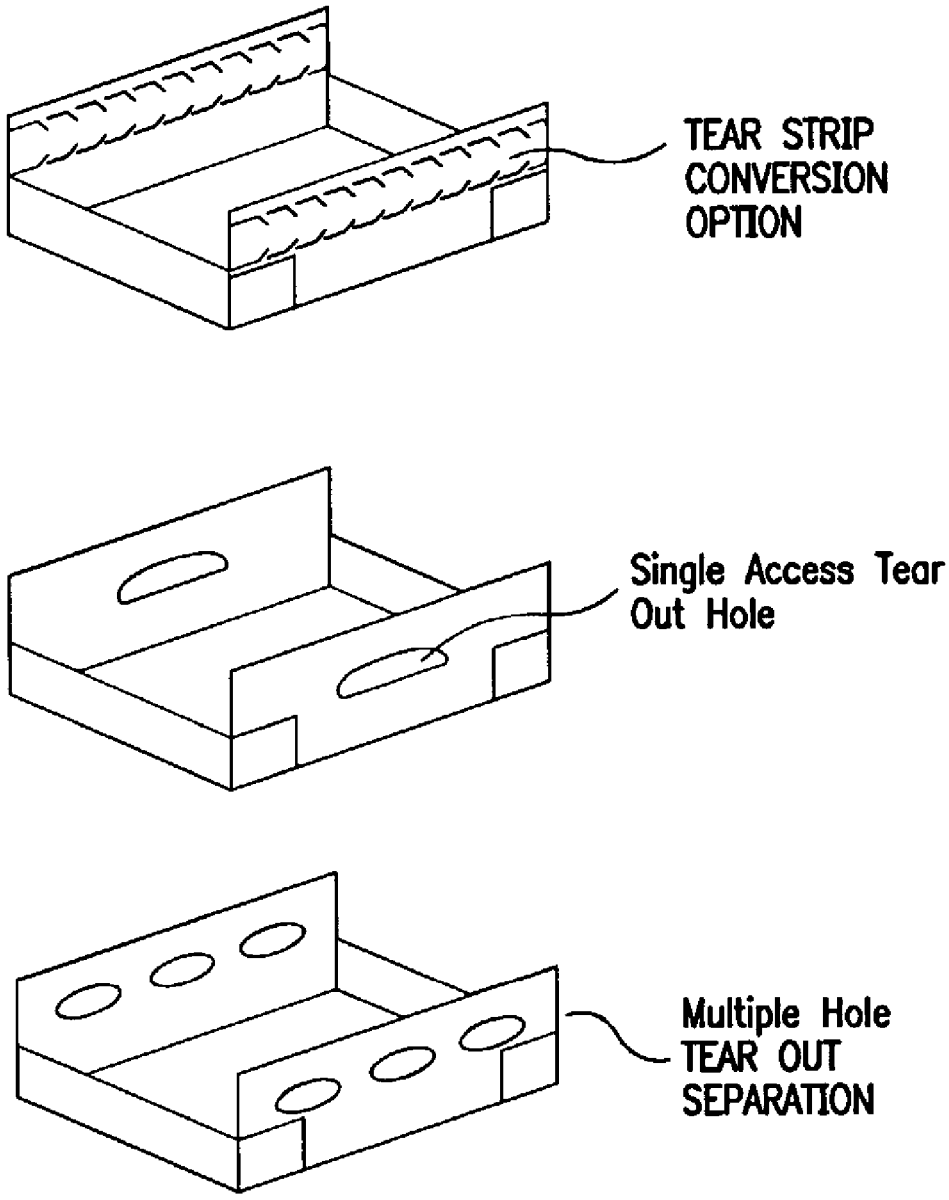
FIG. 37 is a further illustration of alternative tray configurations for use in the three-piece embodiments of the present invention.

FIG. 36 is a further illustration of the three-piece container system, showing how a container may be partially openable, through advantageous positioning of lines of weakness in the Bliss-style cap, as demonstrated in the two-piece embodiments. FIG. 37 is a further illustration of alternative tray configurations for use in the three-piece embodiments of the present invention.

The foregoing description and drawings merely explain and illustrate the invention and the invention is not limited thereto, as those skilled in the art who have the disclosure before them will be able to make modifications and variations therein without departing from the scope of the invention.

What is claimed is:

1. A shipping container convertible to a display container, having a top, a bottom, first and second sides, and first and second ends, said shipping container comprising:

an outer cover member formed from a first blank and comprising:

a bottom panel for forming the bottom of the shipping container;

first and second side panels emanating from first and second opposing sides of the bottom panel;

first and second end panels emanating from first and second opposing ends of the bottom panel, said first and second end panels each including a lower portion and an upper portion, wherein at least one of the first and second end panels has a zone of weakness enabling separation of the lower portion from the upper portion of the at least one of the first and second end panels;

minor flaps emanating from ends of one of the first and second side panels and the first and second end panels, said minor flaps being affixed to one of outer surfaces of the first and second end panels and outer surfaces of the first and second side panels, respectively; and at least one top panel emanating from a top edge of at least one of the first and second end panels; and an internal support member formed from at least a second blank for providing support to the at least one top panel, wherein the upper portions of the first and second end panels are affixed to portions of the internal support member.

2. The shipping container convertible to a display container according to claim 1, wherein both of the first and second end panels include a zone of weakness enabling separation of the lower portion from the upper portion of each of the first and second end panels, and wherein the internal support member is affixed to only at least one of the upper portions of the first and second end panels and the at least one top panel, so that upon separation of the upper portions of the first and second end panels from the lower portions of the first and second end panels, the internal support member may be separated from the lower portions of the first and second end panels, the first and second side panels, and the bottom panel to result in a tray for displaying products that may be contained therein.

3. The shipping container convertible to a display container according to claim 1, wherein the at least one top panel includes a first portion connected to the upper portion of the at least one end panel having a zone of weakness between the upper and lower portions thereof, the first portion of the at least one top panel being releasably connected to the internal support member, whereupon separation of the upper portion of the at least one end panel having a zone of weakness between the upper and lower portions thereof from the lower portion, the first portion of the at least one top panel being separable from the internal support member, to expose at least a portion of the interior of the shipping container.

4. The shipping container convertible to a display container according to claim 1, wherein the at least one top panel comprises two discrete top panels emanating from the top edges of the upper portions of the first and second end panels.

5. The shipping container convertible to a display container according to claim 4, wherein the two discrete top panels have juxtaposed free edges that meet so that a top area of the container is substantially covered by the two discrete top panels.

6. The shipping container convertible to a display container according to claim 1, wherein the internal support member has one of the following top plan configurations upon articulation: rectangular; C-shaped; C-shaped with flanges at right angles to the ends of the legs of the C; F-shaped; E-shaped with flanges at right angles to the ends of the legs of the E; H-shaped; H-shaped with flanges at right angles to the ends of the legs of the H; and H-shaped with L-shaped flanges at right angles to the ends of the legs of the H.

7. The shipping container convertible to a display container according to claim 1, wherein the at least one top panel further comprises at least one top flap emanating from a side edge of the at least one top panel, and affixed to the internal support member.

8. The shipping container convertible to a display container according to claim 1, wherein the zone of weakness is one of the following: a score line; a tear strip; at least one transverse line of perforations; and a punchout formed from a line of perforations defining an enclosed area, the enclosed area within the line of perforations being affixed to the internal support member.

* * * * *